US011062720B2

(12) United States Patent
Baeckstroem et al.

(10) Patent No.: US 11,062,720 B2
(45) Date of Patent: Jul. 13, 2021

(54) CONCEPT FOR ENCODING OF INFORMATION

(71) Applicant: Fraunhofer-Gesellschaft zur Foerderung der angewandten Forschung e.V., Munich (DE)

(72) Inventors: Tom Baeckstroem, Helsinki (FI); Christian Fischer Pedersen, Aarmus (DK); Johannes Fischer, Erlangen (DE); Matthias Huettenberger, Erlangen (DE); Alfonso Pino, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 178 days.

(21) Appl. No.: 16/512,156

(22) Filed: Jul. 15, 2019

(65) Prior Publication Data

US 2019/0341065 A1 Nov. 7, 2019

Related U.S. Application Data

(63) Continuation of application No. 15/258,702, filed on Sep. 7, 2016, now Pat. No. 10,403,298, which is a (Continued)

(30) Foreign Application Priority Data

Mar. 7, 2014 (EP) ..... 14158396
Jul. 28, 2014 (EP) ..... 14178789

(51) Int. Cl.
*G10L 19/06* (2013.01)
*G10L 19/07* (2013.01)
(Continued)

(52) U.S. Cl.
CPC ..... *G10L 19/07* (2013.01); *G10L 19/0212* (2013.01); *G10L 19/038* (2013.01);
(Continued)

(58) Field of Classification Search
CPC ..... G10L 19/06; G10L 19/07; G10L 19/12
See application file for complete search history.

(56) References Cited

U.S. PATENT DOCUMENTS 5,701,390 A 12/1997 Griffin et al.
6,813,602 B2 11/2004 Thyssen
(Continued)

FOREIGN PATENT DOCUMENTS

EP 774750 A2 5/1997
JP 06230797 A 8/1994
(Continued)

OTHER PUBLICATIONS

3GPP, TS 26.190 V7.0.0, "Adaptive Multi-Rate (AMR-WB) Speech Codec" , 3rd Generation Partnership Project; Technical Specification Group Services and System Aspects; Speech Codec Speech Processing Functions; Adaptive Multi-Rate-Wideband (AMR-WB) Speech Codec , 51 pages.
(Continued)

*Primary Examiner* — Bryan S Blankenagel
(74) *Attorney, Agent, or Firm* — Perkins Cole LLP; Michael A. Glenn

(57) ABSTRACT

An information encoder for encoding an information signal includes: a converter for converting the linear prediction coefficients of the predictive polynomial A(z) to frequency values $f_1 \ldots f_n$ of a spectral frequency representation of the predictive polynomial A(z), wherein the converter is configured to determine the frequency values $f_1 \ldots f_n$ by analyzing a pair of polynomials P(z) and Q(z) being defined as
(Continued)

$P(z)=A(z)+z^{-m-l}A(z^{-1})$ and $Q(z)=A(z)-z^{-m-l}A(z^{-1})$, wherein m is an order of the predictive polynomial A(z) and l is greater or equal to zero, wherein the converter is configured to obtain the frequency values by establishing a strictly real spectrum derived from P(z) and a strictly imaginary spectrum from Q(z) and by identifying zeros of the strictly real spectrum derived from P(z) and the strictly imaginary spectrum derived from Q(z).

20 Claims, 8 Drawing Sheets

Related U.S. Application Data continuation of application No. PCT/EP2015/052634, filed on Feb. 9, 2015.

(51) Int. Cl.

| | |
|---|---|
| ***G10L 19/12*** | (2013.01) |
| ***G10L 19/02*** | (2013.01) |
| ***G10L 19/038*** | (2013.01) |
| *G10L 19/00* | (2013.01) |

(52) U.S. Cl.

CPC ..... *G10L 19/06* (2013.01); *G10L 19/12* (2013.01); *G10L 2019/0011* (2013.01); *G10L 2019/0016* (2013.01)

(56) References Cited

U.S. PATENT DOCUMENTS

| | | | | |
|---|---|---|---|---|
| 7,272,556 | B1 | 9/2007 | Aguilar et al. | |
| 7,711,556 | B1 | 5/2010 | Kang et al. | |
| 2002/0038325 | A1* | 3/2002 | Van Den Enden | G10L 19/07 708/300 |
| 2007/0225971 | A1 | 9/2007 | Bessette | |
| 2007/0233472 | A1* | 10/2007 | Sinder | G10L 21/003 704/219 |
| 2010/0286990 | A1 | 11/2010 | Biswas et al. | |
| 2013/0211846 | A1 | 8/2013 | Gibbs et al. | |
| 2013/0275127 | A1 | 10/2013 | Sung et al. | |
| 2014/0257798 | A1 | 9/2014 | Mittal et al. | |

FOREIGN PATENT DOCUMENTS

| | | | |
|---|---|---|---|
| JP | H08272398 | A | 10/1996 |
| JP | 09212198 | A | 8/1997 |
| JP | 3246029 | B2 | 1/2002 |
| JP | 2005533272 | A | 11/2005 |
| RU | 2389085 | C2 | 5/2010 |
| RU | 2456682 | C2 | 7/2012 |
| WO | 2009005305 | A1 | 1/2009 |
| WO | 2014015299 | A1 | 1/2014 |

OTHER PUBLICATIONS

Aberth, Oliver, "Iteration Methods for Finding All Zeros of a Polynomial Simultaneously", Mathematics of computation, vol. 27, No. 122, pp. 339-344.

Bäckström, Tom, et al., "Minimum Separation of Line Spectral Frequencies", IEEE Signal Process Lett., vol. 14. No. 2, pp. 145-147.

Bäckström, Tom, et al., "Properties of Line Spectrum Pair Polynomials—A Review", Signal Processing, vol. 86, No. 11, pp. 3286-3298.

Bäckström, Tom, "Vandermonde Factorization of Toeplitz Matrices and Applications in Filtering and Warping", IEEE Trans. Signal Process., vol. 61, No. 24, pp. 6257-6263.

Bessette, Bruno, et al., "The Adaptive Multirate Wideband Speech Codec (AMR-WB)", IEEE Transactions on Speech and Audio Processing, vol. 10, No. 8, , pp. 620-636.

Durand, E., "Solutions Numériques des Équations Algébriques", Paris, Masson.

Ehrlich, L. W, "A Modified Newton Method for Polynomials", Communications of the ACM, vol. 10, No. 2., Feb. 1967 , pp. 107-108.

Golub, Gene H, et al., "Matrix Computations" , 3rd Edition, John Hopkins University Press , 1996 , 367 pages.

ITU-T G.718, "Frame error robust narrow-band and wideband embedded variable bit-rate coding of speech and audio from 8-32 kbit/s", International Telecommunication Union. Series G: Transmission Systems and Media Digital Systems and Networks., Jun. 2008, 257 pages.

ITU-T G.722.2, "Wideband coding of speech at around 16 kbit/s using Adaptive Multi-Rate Wideband (AMR-WB)", International Telecommunications Union, Series G: Transmission Systems and Media, Digital Systems and Networks. Recommendation G.722.2. Jul. 29, 2003, Jul. 29, 2003.

Kabal, Peter, et al., "The Computation of Line Spectral Frequencies Using Chebyshev Polynomials", Acoustics, Speech and Signal Processing, IEEE Transactions on vol. 34, No. 6 , pp. 1419-1426.

Kang, George S, et al., "Application of Line-Spectrum Pairs to Low-bit Rate Speech Encoders", Acoustics, Speech, and Signal Processing, IEEE International Conference on ICASSP vol. 10., Apr. 26, 1985, pp. 244-247.

Kates, James M, et al., "Multichannel dynamic-range compression using digital frequency warping.", Kates, James M., and Kathryn Hoberg Arehart. "Multichannel dynamic-range compression using digital frequency warping." EURASIP Journal on Applied Signal Processing 2005 (2005): 3003-3014., 2005, 3003-3014.

Kerner, Lmm O, "Ein Gesamtschrittverfahren zur Berechnung der Nullstellen von Polynomen", Numerische Mathematik, vol. 8, May 1966 , pp. 290-294.

Neuendorf, M., et al., "Unified Speech and Audio Coding Scheme for High Quality at Low Bitrates" , IEEE Int'l Conference on Acoustics, Speech and Signal Processing , pp. 1-4.

Pisarenko, V. F, "The Retrieval of Harmonics from a Covariance Function" , Geophysical Journal of the Royal Astronomical Society, vol. 33, No. 3 , 1973 , pp. 347-366.

Saramäki, Tapio, "Finite Impulse Response Filter Design" , Handbook for Digital Signal Processing , pp. 155-277.

Soong, Frank K, et al., "Line Spectrum Pair (LSP) and Speech Data Compression", International Conference on Acoustics, Speech & Signal Processing. ICASSP. San Diego, Mar. 19-21, 1984, Mar. 19, 1984, pp. 1.10.1-1.10.4.

Soong, Frank K., et al., "Line Spectrum Pair (LSP) and Speech Data Compression.", IEEE International Conference of Acoustics, Speech and Signal Proceedings (ICASSP'84), 1984 , 1984 , pp. 37-40.

Starer, David, et al., "Adaptive Polynomial Factorization by Coefficient Matching", IEEE Transactions on Signal Processing, vol. 39, No. 2, pp. 527-530.

Starer, David, et al., "Polynomial Factorization Algorithms for Adaptive Root Estimation", International Conference on Acoustics, Speech, and Signal Processing, vol. 2, Glasgow, UK: IEEE , pp. 1158-1161.

Yedlapalli, Satya Sudhakar, "Transforming Real Linear Prediction Coefficients to Line Spectral Representations with a Real FFT", IEEE Transactions on Speech and Audio Processing, IEEE Service Center, New York, NY, vol. 13, No. 5, Sep. 1, 2005, pp. 733-740.

* cited by examiner

CONCEPT FOR ENCODING OF INFORMATION

CROSS-REFERENCE TO RELATED APPLICATIONS

This application is a continuation of copending U.S. patent application Ser. No. 15/258,702, filed Sep. 7, 2016, which in turn is a continuation of copending International Application No. PCT/EP2015/052634, filed Feb. 9, 2015, which is incorporated herein by reference in its entirety, and additionally claims priority from European Applications Nos. EP 14 158 396.3, filed Mar. 7, 2014, and EP 14 178 789.5, filed Jul. 28, 2014, all of which are incorporated herein by reference in their entirety.

BACKGROUND OF THE INVENTION

The most frequently used paradigm in speech coding is Algebraic Code Excited Linear Prediction (ACELP), which is used in standards such as the AMR-family, G.718 and MPEG USAC [1-3]. It is based on modelling speech using a source model, consisting of a linear predictor (LP) to model the spectral envelope, a long time predictor (LTP) to model the fundamental frequency and an algebraic codebook for the residual.

The coefficients of the linear predictive model are very sensitive to quantization, whereby usually, they are first transformed to Line Spectral Frequencies (LSFs) or Imittance Spectral Frequencies (ISFs) before quantization. The LSF/ISF domains are robust to quantization errors and in these domains; the stability of the predictor can be readily preserved, whereby it offers a suitable domain for quantization [4].

The LSFs/ISFs, in the following referred to as frequency values, can be obtained from a linear predictive polynomial A(z) of order m as follows. The Line Spectrum Pair polynomials are defined as $$P(z)=A(z)+z^{-m-l}A(z^{-1})$$

$$Q(z)=A(z)-z^{-m-l}A(z^{-1}) \quad (1)$$

where l=1 for the Line Spectrum Pair and l=0 for the Imittance Spectrum Pair representation, but any l≥0 is in principle valid. In the following, it thus will be assumed only that l≥0.

Note that the original predictor can be reconstructed using A(z)=½ [P(z)+Q(z)]. The polynomials P(z) and Q(z) thus contain all the information of A(z).

The central property of LSP/ISP polynomials is that if and only if A(z) has all its roots inside the unit circle, then the roots of P(z) and Q(z) are interlaced on the unit circle. Since the roots of P(z) and Q(z) are on the unit circle, they can be represented by their angles only. These angles correspond to frequencies and since the spectra of P(z) and Q(z) have vertical lines in their logarithmic magnitude spectra at frequencies corresponding to the roots, the roots are referred to as frequency values.

It follows that the frequency values, encode all information of the predictor A(z). Moreover, it has been found that frequency values are robust to quantization errors such that a small error in one of the frequency values produces a small error in spectrum of the reconstructed predictor which is localized, in the spectrum, near the corresponding frequency. Due to these favorable properties, quantization in the LSF or ISF domains is used in all main-stream speech codecs [1-3].

One of the challenges in using frequency values is, however, finding their locations efficiently from the coefficients of the polynomials P(z) and Q(z). After all, finding the roots of polynomials is a classic and difficult problem. The previously proposed methods for this task include the following approaches: One of the early approaches uses the fact that zeros reside on the unit circle, whereby they appear as zeros in the magnitude spectrum [5]. By taking the discrete Fourier transform of the coefficients of P(z) and Q(z), one can thus search for valleys in the magnitude spectrum. Each valley indicates the location of a root and if the spectrum is upsampled sufficiently, one can find all roots. This method however yields only an approximate position, since it is difficult to determine the exact position from the valley location.

The most frequently used approach is based on Chebyshev polynomials and was presented in [6]. It relies on the realization that the polynomials P (z) and Q(z) are symmetric and antisymmetric, respectively, whereby they contain plenty of redundant information. By removing trivial zeros at z=±1 and with the substitution $x=z+z^{-1}$ (which is known as the Chebyshev transform), the polynomials can be transformed to an alternative representation FP (x) and FQ(x). These polynomials are half the order of P(z) and Q(z) and they have only real roots on the range −2 to +2. Note that the polynomials FP(x) and FQ(x) are real-valued when x is real. Moreover, since the roots are simple, FP(x) and FQ(x) will have a zero-crossing at each of their roots.

In speech codecs such as the AMR-WB, this approach is applied such that the polynomials FP(x) and FQ(x) are evaluated on a fixed grid on the real axis to find all zero-crossings. The root locations are further refined by linear interpolation around the zero-crossing. The advantage of this approach is the reduced complexity due to omission of redundant coefficients.

While the above described methods work sufficiently in existing codecs, they do have a number of problems.

SUMMARY

According to an embodiment, an information encoder for encoding an information signal, may have: an analyzer for analyzing the information signal in order to acquire linear prediction coefficients of a predictive polynomial A(z); a converter for converting the linear prediction coefficients of the predictive polynomial A(z) to frequency values $f_1 \ldots f_n$ of a spectral frequency representation of the predictive polynomial A(z), wherein the converter is configured to determine the frequency values $f_1 \ldots f_n$ by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the converter is configured to acquire the frequency values by establishing a strictly real spectrum derived from P(z) and a strictly imaginary spectrum from Q(z) and by identifying zeros of the strictly real spectrum derived from P(z) and the strictly imaginary spectrum derived from Q(z); a quantizer for acquiring quantized frequency values from the frequency values; and a bitstream producer for producing a bitstream comprising the quantized frequency values.

According to another embodiment, a method for operating an information encoder for encoding an information signal may have the steps of: analyzing the information signal in order to acquire linear prediction coefficients of a predictive polynomial A(z); converting the linear prediction coefficients of the predictive polynomial A(z) to frequency values of a spectral frequency representation of the predictive polynomial A(z), wherein the frequency values are determined by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the frequency values are acquired by establishing a strictly real spectrum derived from P(z) and a strictly imaginary spectrum from Q(z) and by identifying zeros of the strictly real spectrum derived from P(z) and the strictly imaginary spectrum derived from Q(z); acquiring quantized frequency values from the frequency values; and producing a bitstream comprising the quantized frequency values.

Another embodiment may have a non-transitory digital storage medium having a computer program stored thereon to perform the method for operating an information encoder for encoding an information signal, the method comprising: analyzing the information signal in order to acquire linear prediction coefficients of a predictive polynomial A(z); converting the linear prediction coefficients of the predictive polynomial A(z) to frequency values of a spectral frequency representation of the predictive polynomial A(z), wherein the frequency values are determined by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the frequency values are acquired by establishing a strictly real spectrum derived from P(z) and a strictly imaginary spectrum from Q(z) and by identifying zeros of the strictly real spectrum derived from P(z) and the strictly imaginary spectrum derived from Q(z); acquiring quantized frequency values from the frequency values; and producing a bitstream comprising the quantized frequency values, when said computer program is run by a computer.

In a first aspect the problem is solved by an information encoder for encoding an information signal. The information encoder comprises:

an analyzer for analyzing the information signal in order to obtain linear prediction coefficients of a predictive polynomial A(z);

a converter for converting the linear prediction coefficients of the predictive polynomial A(z) to frequency values of a spectral frequency representation of the predictive polynomial A(z), wherein the converter is configured to determine the frequency values by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the converter is configured to obtain the frequency values by establishing a strictly real spectrum derived from P(z) and a strictly imaginary spectrum from Q(z) and by identifying zeros of the strictly real spectrum derived from P(z) and the strictly imaginary spectrum derived from Q(z);

a quantizer for obtaining quantized frequency values from the frequency values; and a bitstream producer for producing a bitstream comprising the quantized frequency values.

The information encoder according to the invention uses a zero crossing search, whereas the spectral approach for finding the roots according to conventional technology relies on finding valleys in the magnitude spectrum. However, when searching for valleys, the accuracy is poorer than when searching for zero-crossings. Consider, for example, the sequence [4, 2, 1, 2, 3]. Clearly, the smallest value is the third element, whereby the zero would lie somewhere between the second and the fourth element. In other words, one cannot determine whether the zero is on the right or left side of the third element. However, if one considers the sequence [4, 2, 1, −2, −3], one can immediately see that the zero crossing is between the third and fourth elements, whereby our margin of error is reduced in half. It follows that with the magnitude-spectrum approach, one need double the number of analysis points to obtain the same accuracy as with the zero-crossing search.

In comparison to evaluating the magnitudes |P (z)| and |Q(z)|, the zero-crossing approach has a significant advantage in accuracy. Consider, for example, the sequence 3, 2, −1, −2. With the zero-crossing approach it is obvious that the zero lies between 2 and −1. However, by studying the corresponding magnitude sequence 3, 2, 1, 2, one can only conclude that the zero lies somewhere between the second and the last elements. In other words, with the zero-crossing approach the accuracy is double in comparison to the magnitude-based approach.

Furthermore, the information encoder according to the invention may use long predictors such as m=128. In contrast to that, the Chebyshev transform performs sufficiently only when the length of A(z) is relatively small, for example m≤20. For long predictors, the Chebyshev transform is numerically unstable, whereby practical implementation of the algorithm is impossible.

The main properties of the proposed information encoder are thus that one may obtain as high or better accuracy as the Chebyshev-based method since zero crossings are searched and because a time domain to frequency domain conversion is done, so that the zeros may be found with very low computational complexity.

As a result the information encoder according to the invention determines the zeros (roots) both more accurately, but also with low computational complexity.

The information encoder according to the invention can be used in any signal processing application which needs to determine the line spectrum of a sequence. Herein, the information encoder is exemplary discussed in the context speech coding. The invention is applicable in a speech, audio and/or video encoding device or application, which employs a linear predictor for modelling the spectral magnitude envelope, perceptual frequency masking threshold, temporal magnitude envelope, perceptual temporal masking threshold, or other envelope shapes, or other representations equivalent to an envelope shape such as an autocorrelation signal, which uses a line spectrum to represent the information of the envelope, for encoding, analysis or processing, which needs a method for determining the line spectrum from an input signal, such as a speech or general audio signal, and where the input signal is represented as a digital filter or other sequence of numbers.

The information signal may be for instance an audio signal or a video signal. The frequency values may be line spectral frequencies or Imittance spectral frequencies. The quantized frequency values transmitted within the bitstream will enable a decoder to decode the bitstream in order to re-create the audio signal or the video signal.

According to an embodiment of the invention the converter comprises a determining device to determine the polynomials P(z) and Q(z) from the predictive polynomial A(z).

According to an embodiment of the invention the converter comprises a zero identifier for identifying the zeros of the strictly real spectrum derived from P(z) and the strictly imaginary spectrum derived from Q(z).

According to an embodiment of the invention the zero identifier is configured for identifying the zeros by a) starting with the real spectrum at null frequency;
b) increasing frequency until a change of sign at the real spectrum is found;
c) increasing frequency until a further change of sign at the imaginary spectrum is found; and
d) repeating steps b) and c) until all zeros are found.

Note that Q(z) and thus the imaginary part of the spectrum has a zero at the null frequency. Since the roots are overlapping, P(z) and thus the real part of the spectrum will then be non-zero at the null frequency. One can therefore start with the real part at the null frequency and increase the frequency until the first change of sign is found, which indicates the first zero-crossing and thus the first frequency value.

Since the roots are interlaced, the spectrum of Q(z) will have the next change in sign. One can thus increase the frequency until a change of sign for the spectrum of Q(z) is found. This process then may be repeated, alternating between the spectraP(z) and Q(z), until all frequency values have been found. The approach used for locating the zero-crossing in the spectra is thus similar to the approach applied in the Chebyshev-domain [6, 7].

Since the zeros of P (z) and Q(z) are interlaced, one can alternate between searching for zeros on the real and complex parts, such that one finds all zeros in one pass, and reduce complexity by half in comparison to a full search. According to an embodiment of the invention the zero identifier is configured for identifying the zeros by interpolation.

In addition to the zero-crossing approach one can readily apply interpolation such that one can estimate the position of the zero with even higher accuracy, for example, as it is done in conventional methods, e.g. [7].

According to an embodiment of the invention the converter comprises a zero-padding device for adding one or more coefficients having a value "0" to the polynomials P(z) and Q(z) so as to produce a pair of elongated polynomials $P_e(z)$ and $Q_e(z)$. Accuracy can be further improved by extending the length of the evaluated spectrum. Based on information about the system, it is actually possible in some cases to determine a minimum distance between the frequency values, and thus determine the minimum length of the spectrum with which all frequency values can be found [8].

According to an embodiment of the invention the converter is configured in such way that during converting the linear prediction coefficients to frequency values of a spectral frequency representation of the predictive polynomial A(z) at least a part of operations with coefficients known to be have the value "0" of the elongated polynomials $P_e(z)$ and $Q_e(z)$ are omitted.

Increasing the length of the spectrum does however also increase computational complexity. The largest contributor to the complexity is the time domain to frequency domain transform, such as a fast Fourier transform, of the coefficients of A(z). Since the coefficient vector has been zero-padded to the desired length, it is however very sparse. This fact can readily be used to reduce complexity. This is a rather simple problem in the sense that one knows exactly which coefficients are zero, whereby on each iteration of the fast Fourier transform one can simply omit those operations which involve zeros. Application of such sparse fast Fourier transform is straightforward and any programmer skilled in the art can implement it. The complexity of such an implementation is $O(N \log_2(1+m+l))$, where N is the length of the spectrum and m and l are defined as before.

According to an embodiment of the invention the converter comprises a composite polynomial former configured to establish a composite polynomial $C_e(P_e(z), Q_e(z))$ from the elongated polynomials $P_e(Z)$ and $Q_e(Z)$.

According to an embodiment of the invention the converter is configured in such way that the strictly real spectrum derived from P(z) and the strictly imaginary spectrum from Q(z) are established by a single Fourier transform by transforming the composite polynomial $C_e(P_e(Z), Q_e(Z))$.

According to an embodiment invention the converter comprises a Fourier transform device for Fourier transforming the pair of polynomials P(z) and Q(z) or one or more polynomials derived from the pair of polynomials P(z) and Q(z) into a frequency domain and an adjustment device for adjusting a phase of the spectrum derived from P(z) so that it is strictly real and for adjusting a phase of the spectrum derived from Q(z) so that it is strictly imaginary. The Fourier transform device may be based on the fast Fourier transform or on the discrete Fourier transform.

According to an embodiment of the invention the adjustment device is configured as a coefficient shifter for circular shifting of coefficients of the pair of polynomials P(z) and Q(z) or one or more polynomials derived from the pair of polynomials P(z) and Q(z).

According to an embodiment of the invention the coefficient shifter is configured for circular shifting of coefficients in such way that an original midpoint of a sequence of coefficients is shifted to the first position of the sequence. In theory, it is well known that the Fourier transform of a symmetric sequence is real-valued and antisymmetric sequences have purely imaginary Fourier spectra. In the present case, our input sequence is the coefficients of polynomial P(z) or Q(z) which is of length m+l, whereas the discrete Fourier transform of a much greater length N>>(m+l) would be advantageous. The conventional approach for creating longer Fourier spectra is zero-padding of the input signal. However, zero-padding the sequence has to be carefully implemented such that the symmetries are retained.

First a polynomial P(z) with coefficients $[p_0, p_1, p_2, p_1, p_0]$ is considered.

The way FFT algorithms are usually applied necessitates that the point of symmetry is the first element, whereby when applied for example in MATLAB one can write $\mathrm{fft}([p_2, p_1, p_0, p_0, p_1])$ to obtain a real-valued output. Specifically, a circular shift may be applied, such that the point of symmetry corresponding to the mid-point element, that is, coefficient $p_2$ is shifted left such that it is at the first position. The coefficients which were on the left side of $p_2$ are then appended to the end of the sequence.

For a zero-padded sequence $[p_0, p_1, p_2, p_1, p_0, 0, 0 \ldots 0]$ one can apply the same process. The sequence $[p_2, p_1, p_0, 0, 0 \ldots 0, p_0, p]$ will thus have a real-valued discrete Fourier transform. Here the number of zeros in the input sequences is N−m−l if N is the desired length of the spectrum.

Correspondingly, consider the coefficients $[q_0, q_1, 0, -q_1, -q_0]$ corresponding to polynomial Q(z). By applying a circular shift such that the former midpoint comes to the first position, one obtains $[0, -q_1, -q_0, q_0, q_1]$ which has a purely imaginary discrete Fourier transform. The zero-padded transform can then be taken for the sequence $[0, -q_1, -q_0, 0, 0 \ldots 0, q_0, q_1]$ Note that the above applies only for cases where the length of the sequence is odd, whereby m+l is even. For cases where m+l is odd, one have two options. Either one can implement the circular shift in the frequency domain or apply a DFT with half-samples (see below).

According to an embodiment of the invention the adjustment device is configured as a phase shifter for shifting a phase of the output of the Fourier transform device.

According to an embodiment of the invention the phase shifter is configured for shifting the phase of the output of the Fourier transform device by multiplying a k-th frequency bin with $\exp(i2\pi kh/N)$, wherein N is the length of the sample and h=(m+l)/2.

It is well-known that a circular shift in the time-domain is equivalent with a phase-rotation in the frequency-domain. Specifically, a shift of h=(m+l)/2 steps in the time domain corresponds to multiplication of the k-th frequency bin with $\exp(-i2\pi kh/N)$, where N is the length of the spectrum. Instead of the circular shift, one can thus apply a multiplication in the frequency-domain to obtain exactly the same result. The cost of this approach is a slightly increased complexity. Note that h=(m+l)/2 is an integer number only when m+l is even. When m+l is odd, the circular shift would involve a delay by rational number of steps, which is difficult to implement directly. Instead, one can apply the corresponding shift in the frequency domain by the phase-rotation described above.

According to an embodiment of the invention the converter comprises a Fourier transform device for Fourier transforming the pair of polynomials P(z) and Q(z) or one or more polynomials derived from the pair of polynomials P(z) and Q(z) into a frequency domain with half samples so that the spectrum derived from P(z) is strictly real and so that the spectrum derived from Q(z) is strictly imaginary.

An alternative is to implement a DFT with half-samples. Specifically, whereas the conventional DFT is defined as $$X_k = \sum_{n=0}^{N-1} x_N \exp(-i2\pi kn/N) \tag{2}$$

one can define the half-sample DFT as $$X_k = \sum_{n=0}^{N-1} x_N \exp\left(-i2\pi k\left(n+\frac{1}{2}\right)/N\right) \tag{3}$$

A fast implementation as FFT can readily be devised for this formulation.

The benefit of this formulation is that now the point of symmetry is at n=½ instead of the usual n=1. With this half-sample DFT one would then with a sequence

[2, 1, 0, 0, 1, 2]

obtain a real-valued Fourier spectrum.

In the case of odd m+l, for a polynomial P(z) with coefficients $p_0, p_1, p_2, p_2, p_1, p_0$ one can then with a half-sample DFT and zero padding obtain a real valued spectrum when the input sequence is $[p_2, p_1, p_0, 0, 0 \ldots 0, p_0, p_1, p_2]$.

Correspondingly, for a polynomial Q(z) one can apply the half-sample DFT on the sequence $[-q_2, -q_1, -q_0, 0, 0 \ldots 0, q_0, q_1, q_2]$ to obtain a purely imaginary spectrum.

With these methods, for any combination of m and l, one can obtain a real valued spectrum for a polynomial P(z) and a purely imaginary spectrum for any Q(z). In fact, since the spectra of P(z) and Q(z) are purely real and imaginary, respectively, one can store them in a single complex spectrum, which then corresponds to the spectrum of P(z)+Q(z)=2A(z). Scaling by the factor 2 does not change the location of roots, whereby it can be ignored. One can thus obtain the spectra of P(z) and Q(z) by evaluating only the spectrum of A(z) using a single FFT. One only need to apply the circular shift, as explained above, to the coefficients of A(z).

For example, with m=4 and l=0, the coefficients of A(z) are $[a_0, a_1, a_2, a_3, a_4]$ which one can zero-pad to an arbitrary length N by $[a_0, a_1, a_2, a_3, a_4, 0, 0 \ldots 0]$.

If one then applies a circular shift of (m+l)/2=2 steps, one obtains $[a_2, a_3, a_4, 0, 0 \ldots 0, a_0, a_1]$.

By taking the DFT of this sequence, one has the spectrum of P(z) and Q(z) in the real and complex parts of the spectrum.

According to an embodiment of the invention the converter comprises a composite polynomial former configured to establish a composite polynomial C(P(z), Q(z)) from the polynomials P(z) and Q(z).

According to an embodiment of the invention the converter is configured in such way that the strictly real spectrum derived from P(z) and the strictly imaginary spectrum from Q(z) are established by a single Fourier transform, for example a fast Fourier transform (FFT), by transforming a composite polynomial C(P(z), Q(z)).

The polynomials P (z) and Q(z) are symmetric and antisymmetric, respectively, with the axis of symmetry at $z^{-(m+l)/2}$. It follows that the spectra of $z^{-(m+l)/2}P(z)$ and $z^{-(m+l)/2}Q(z)$, respectively, evaluated on the unit circle $z=\exp(i\theta)$, are real and complex valued, respectively. Since the zeros are on the unit circle, one can find them by searching for zero-crossings. Moreover, the evaluation on the unit-circle can be implemented simply by an fast Fourier transform.

As the spectra corresponding to $z^{-(m+l)/2}P(z)$ and $z^{-(m+l)/2}Q(z)$ are real and complex, respectively, 2 is one can implement them with a single fast Fourier transform. Specifically, if one take the sum $z^{-(m+l)/2}(P(z)+Q(z))$ then the real and complex parts of the spectra correspond to $z^{-(m+l)/2}P(z)$ and $z^{-(m+l)/2}Q(z)$, respectively. Moreover, since $$z^{-(m+l)/2}(P(Z)+Q(z))=2z^{-(m+l)/2}A(z), \tag{4}$$

one can directly take the FFT of $2z^{-(m+l)/2}A(z)$ to obtain the spectra corresponding to $z^{-(m+l)/2}P(z)$ and $z^{-(m+l)/2}Q(z)$, without explicitly determining P(z) and Q(z). Since one is interested only in the locations of zeros, 1 can omit multiplication by the scalar 2 and evaluate $z^{-(m+l)/2}$ A(z) by FFT instead. Observe that since A(z) has only m+1 non-zero coefficients, one can use FFT pruning to reduce complexity [11]. To ensure that all roots are found, one has to use an FFT of sufficiently high length N that the spectrum is evaluated on at least one frequency between every two zeros.

According to an embodiment of the invention the converter comprises a limiting device for limiting the numerical range of the spectra of the polynomials P(z) and Q(z) by multiplying the polynomials P(z) and Q(z) or one or more polynomials derived from the polynomials P(z) and Q(z) with a filter polynomial B(z), wherein the filter polynomial B(z) is symmetric and does not have any roots on a unit circle.

Speech codecs are often implemented on mobile device with limited resources, whereby numerical operations need to be implemented with fixed-point representations. It is therefore essential that algorithms implemented operate with numerical representations whose range is limited. For common speech spectral envelopes, the numerical range of the Fourier spectrum is, however, so large that one needs a 32-bit implementation of the FFT to ensure that the location of zero-crossings are retained.

A 16-bit FFT can, on the other hand, often be implemented with lower complexity, whereby it would be beneficial to limit the range of spectral values to fit within that 16-bit range. From the equations $|P(e^{i\theta})|\leq 2|A(e^{i\theta})|$ and $|Q(e^{i\theta})|\leq 2|A(e^{i\theta})|$ it is known that by limiting the numerical range of B(z)A(z) one also limits the numerical range of B(z)P (z) and B(z)Q(z). If B(z) does not have zeros on the unit circle, then B(z)P (z) and B(z)Q(z) will have the same zero-crossing on the unit circle as P (z) and Q(z). Moreover, B(z) has to be symmetric such that $z^{-(m+l+n)/2}$P (z)B(z) and $z^{-(m+l+n)/2}$Q(z)B(z) remain symmetric and antisymmetric and their spectra are purely real and imaginary, respectively. Instead of evaluating the spectrum of $z^{(n+l)/2}$A(z) one can thus evaluate $z^{(n+l+n)/2}$A(z)B(z), where B(z) is an order n symmetric polynomial without roots on the unit circle. In other words, one can apply the same approach as described above, but first multiplying A(z) with filter B(z) and applying a modified phase-shift $z^{-(m+l+n)/2}$.

The remaining task is to design a filter B(z) such that the numerical range of A(z)B(z) is limited, with the restriction that B(z) has to be symmetric and without roots on the unit circle. The simplest filter which fulfills the requirements is an order 2 linear-phase filter $$B_1(z)=\beta_0+\beta_1 z^{-1}+\beta_2 z^{-2} \tag{5}$$

where $\beta_k\in R$ are the parameters and $|\beta_2|>2|\beta_1|$. By adjusting $\beta_k$ one can modify the spectral tilt and thus reduce the numerical range of the product $A(z)B_1(z)$. A computationally very efficient approach is to choose 3 such that the magnitude at 0-frequency and Nyquist is equal, $|A(1)B_1(1)|=|A(-1)B_1(-1)|$, whereby one can choose for example $$\beta_0=A(1)-A(-1) \text{ and } \beta_1=2(A(1)+A(-1)). \tag{6}$$

This approach provides an approximately flat spectrum.

One observes (see also FIG. 5) that whereas A(z) has a high-pass character, $B_1(z)$ is low-pass, whereby the product $A(z)B_1(z)$ has, as expected, equal magnitude at 0- and Nyquist-frequency and it is more or less flat. Since $B_1(z)$ has only one degree of freedom, one obviously cannot expect that the product would be completely flat. Still, observe that the ratio between the highest peak and lowest valley of $B_1(z)A(z)$ maybe much smaller than that of A(z). This means that one have obtained the desired effect; the numerical range of $B_1(z)A(z)$ is much smaller than that of A(z).

A second, slightly more complex method is to calculate the autocorrelation $r_k$ of the impulse response of A(0.5z). Here multiplication by 0.5 moves the zeros of A(z) in the direction of origo, whereby the spectral magnitude is reduced approximately by half. By applying the Levinson-Durbin on the autocorrelation $r_k$, one obtains a filter H(z) of order n which is minimum-phase. One can then define $B_2(z)=z^{-n}H(z)H(z^{-1})$ to obtain a $|B_2(z)A(z)|$ which is approximately constant. One will note that the range of $|B_2(z)A(z)|$ is smaller than that of $|B_1(z)A(z)|$. Further approaches for the design of B(z) can be readily found in classical literature of FIR design [18].

According to an embodiment of the invention the converter comprises a limiting device for limiting the numerical range of the spectra of the elongated polynomials $P_e(z)$ and $Q_e(z)$ or one or more polynomials derived from the elongated polynomials $P_e(Z)$ and $Q_e(z)$ by multiplying the elongated polynomials $P_e(Z)$ and $Q_e(Z)$ with a filter polynomial B(z), wherein the filter polynomial B(z) is symmetric and does not have any roots on a unit circle. B(z) can be found as explained above.

In a further aspect the problem is solved by a method for operating an information encoder for encoding an information signal. The method comprises the steps of:

analyzing the information signal in order to obtain linear prediction coefficients of a predictive polynomial A(z);

converting the linear prediction coefficients of the predictive polynomial A(z) to frequency values $f_1 \ldots f_n$ of a spectral frequency representation of the predictive polynomial A(z), wherein the frequency values $f_1 \ldots f_n$ are determined by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the frequency values $f_1 \ldots f_n$ are obtained by establishing a strictly real spectrum derived from P(z) and a strictly imaginary spectrum from Q(z) and by identifying zeros of the strictly real spectrum derived from P(z) and the strictly imaginary spectrum derived from Q(z);

obtaining quantized frequency $f_{q1} \ldots f_{qn}$ values from the frequency values $f_1 \ldots f_n$; and producing a bitstream comprising the quantized frequency values $f_{q1} \ldots f_{qn}$.

Moreover, the program is noticed by a computer program for, when running on a processor, executing the method according to the invention.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
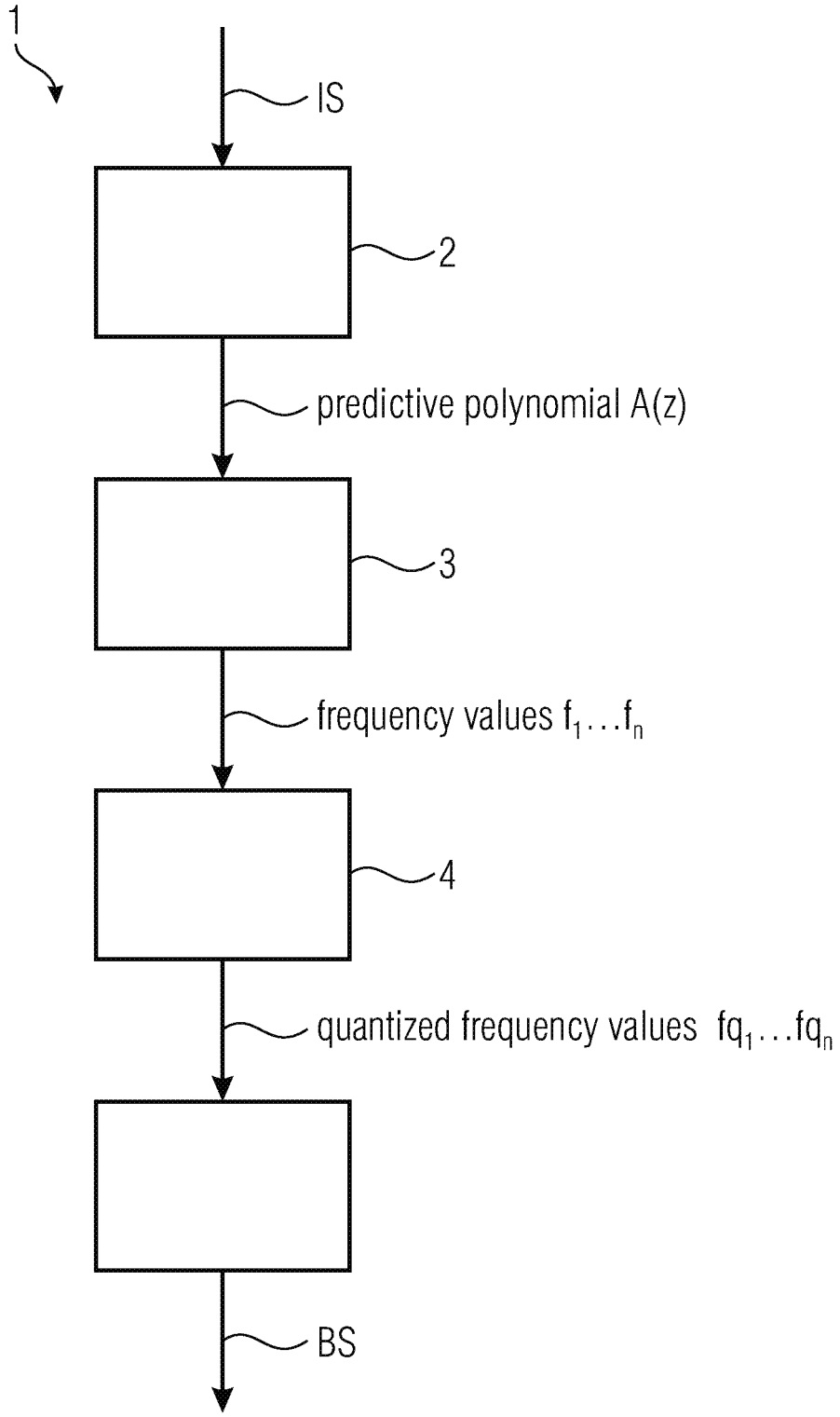
FIG. 1 illustrates an embodiment of an information encoder according to the invention in a schematic view.

FIG. 1 illustrates an embodiment of an information encoder 1 according to the invention in a schematic view.

The information encoder 1 for encoding an information signal IS, comprises:

an analyzer 2 for analyzing the information signal IS in order to obtain linear prediction coefficients of a predictive polynomial A(z);

a converter 3 for converting the linear prediction coefficients of the predictive polynomial A(z) to frequency values $f_1 \ldots f_n$ of a spectral frequency representation RES, IES of the predictive polynomial A(z), wherein the converter 3 is configured to determine the frequency values $f_1 \ldots f_n$ by analyzing a pair of polynomials P(z) and Q(z) being defined as $$P(z)=A(z)+z^{-m-l}A(z^{-1}) \text{ and}$$

$$Q(z)=A(z)-z^{-m-l}A(z^{-1}),$$

wherein m is an order of the predictive polynomial A(z) and l is greater or equal to zero, wherein the converter 3 is configured to obtain the frequency values $f_1 \ldots f_n$ by establishing a strictly real spectrum RES derived from P(z) and a strictly imaginary spectrum IES from Q(z) and by identifying zeros of the strictly real spectrum RES derived from P(z) and the strictly imaginary spectrum IES derived from Q(z);

a quantizer 4 for obtaining quantized frequency $f_{q1} \ldots f_{qn}$ values from the frequency values $f_1 \ldots f_n$; and a bitstream producer 5 for producing a bitstream BS comprising the quantized frequency values $f_{q1} \ldots f_{qn}$.

The information encoder 1 according to the invention uses a zero crossing search, whereas the spectral approach for finding the roots according to conventional technology relies on finding valleys in the magnitude spectrum.

However, when searching for valleys, the accuracy is poorer than when searching for zero-crossings. Consider, for example, the sequence [4, 2, 1, 2, 3]. Clearly, the smallest value is the third element, whereby the zero would lie somewhere between the second and the fourth element. In other words, one cannot determine whether the zero is on the right or left side of the third element. However, if one considers the sequence [4, 2, 1, −2, −3], one can immediately see that the zero crossing is between the third and fourth elements, whereby our margin of error is reduced in half. It follows that with the magnitude-spectrum approach, one need double the number of analysis points to obtain the same accuracy as with the zero-crossing search.

In comparison to evaluating the magnitudes |P (z)| and |Q(z)|, the zero-crossing approach has a significant advantage in accuracy. Consider, for example, the sequence 3, 2, −1, −2. With the zero-crossing approach it is obvious that the zero lies between 2 and −1. However, by studying the corresponding magnitude sequence 3, 2, 1, 2, one can only conclude that the zero lies somewhere between the second and the last elements. In other words, with the zero-crossing approach the accuracy is double in comparison to the magnitude-based approach.

Furthermore, the information encoder according to the invention may use long predictors such as m=128. In contrast to that, the Chebyshev transform performs sufficiently only when the length of A(z) is relatively small, for example m≤20. For long predictors, the Chebyshev transform is numerically unstable, whereby practical implementation of the algorithm is impossible.

The main properties of the proposed information encoder 1 are thus that one may obtain as high or better accuracy as the Chebyshev-based method since zero crossings are searched and because a time domain to frequency domain conversion is done, so that the zeros may be found with very low computational complexity.

As a result the information encoder 1 according to the invention determines the zeros (roots) both more accurately, but also with low computational complexity.

The information encoder 1 according to the invention can be used in any signal processing application which needs to determine the line spectrum of a sequence. Herein, the information encoder 1 is exemplary discussed in the context speech coding. The invention is applicable in a speech, audio and/or video encoding device or application, which employs a linear predictor for modelling the spectral magnitude envelope, perceptual frequency masking threshold, temporal magnitude envelope, perceptual temporal masking threshold, or other envelope shapes, or other representations equivalent to an envelope shape such as an autocorrelation signal, which uses a line spectrum to represent the information of the envelope, for encoding, analysis or processing, which needs a method for determining the line spectrum from an input signal, such as a speech or general audio signal, and where the input signal is represented as a digital filter or other sequence of numbers.

The information signal IS may be for instance an audio signal or a video signal.

Figure 2:
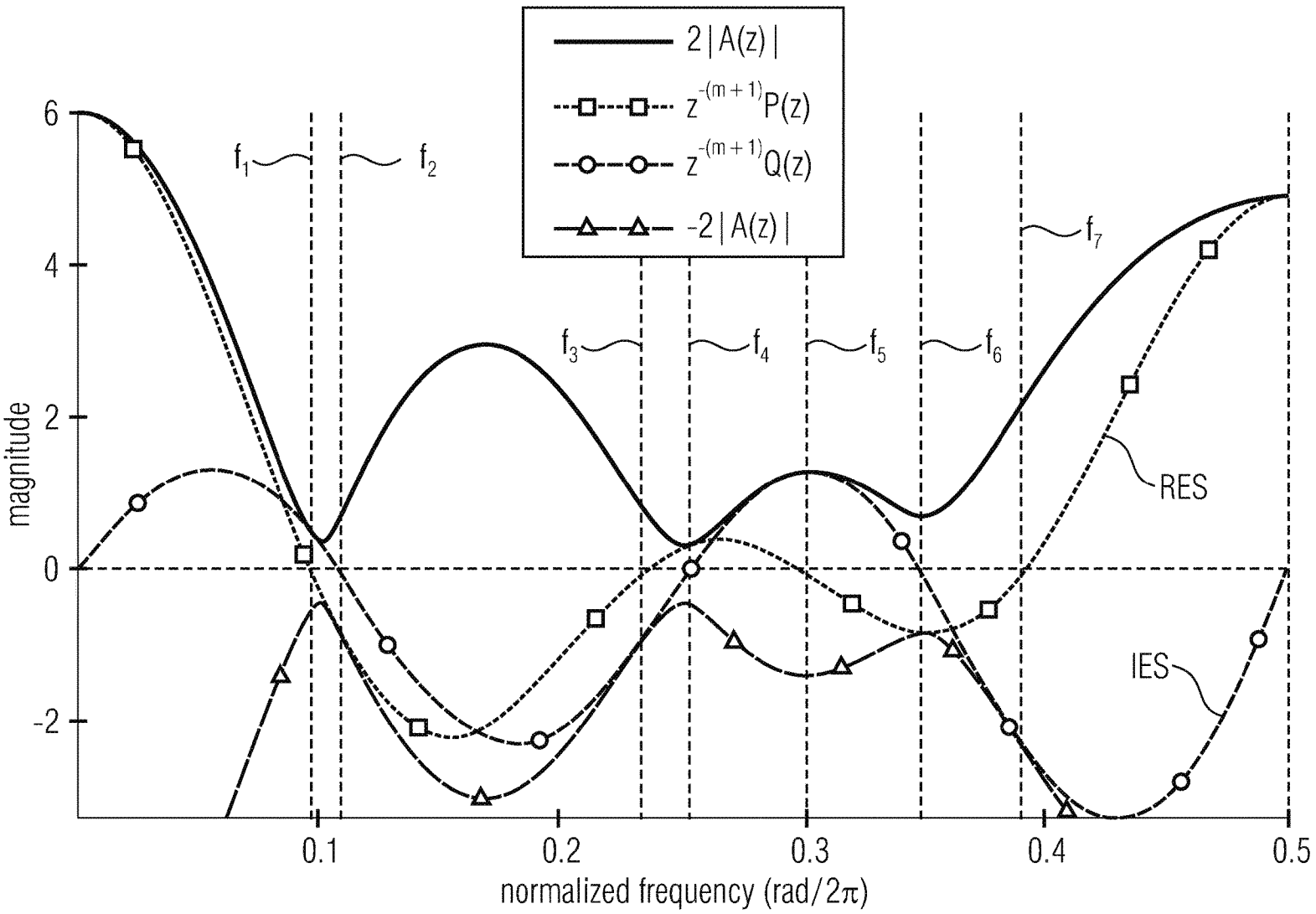
FIG. 2 illustrates an exemplary relation of A(z), P (z) and Q(z)

FIG. 2 illustrates an exemplary relation of A(z), P (z) and Q(z). The vertical dashed lines depict the frequency values $f_1 \ldots f_6$. Note that the magnitude is expressed on a linear axis instead of the decibel scale in order to keep zero-crossings visible. We can see that the line spectral frequencies occur at the zeros crossings of P (z) and Q(z). Moreover, the magnitudes of P (z) and Q(z) are smaller or equal than 2|A(z)| everywhere; $|P(e^{i\theta})| \leq 2|A(e^{j\theta})|$ and $|Q(e^{i\theta})| \leq 2|A(e^{i\theta})|$.

Figure 3:
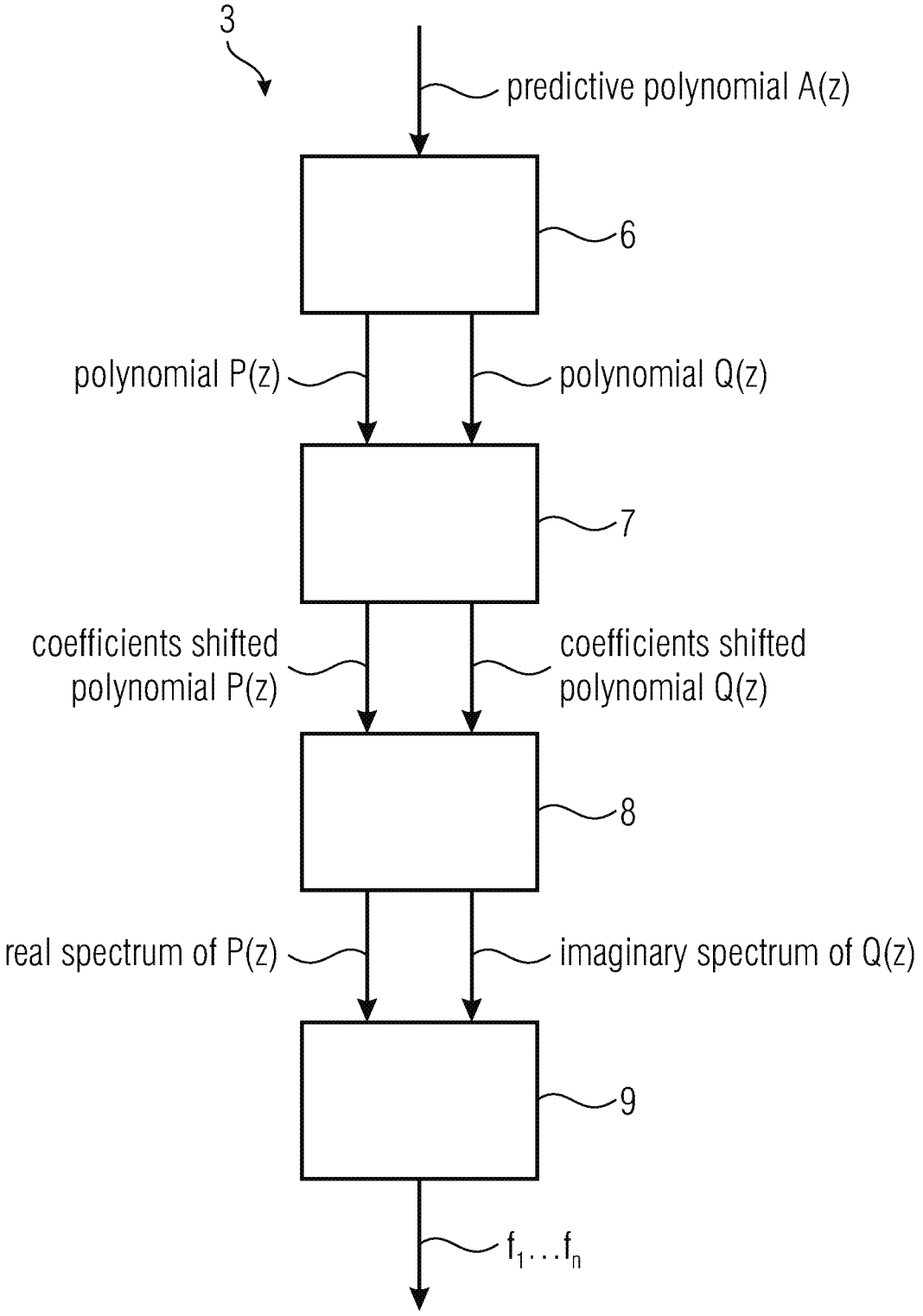
FIG. 3 illustrates a first embodiment of the converter of the information encoder according to the invention in a schematic view.

FIG. 3 illustrates a first embodiment of the converter of the information encoder according to the invention in a schematic view.

According to an embodiment of the invention the converter 3 comprises a determining device 6 to determine the polynomials P(z) and Q(z) from the predictive polynomial A(z).

According to an embodiment invention the converter comprises a Fourier transform device 8 for Fourier transforming the pair of polynomials P(z) and Q(z) or one or more polynomials derived from the pair of polynomials P(z) and Q(z) into a frequency domain and an adjustment device 7 for adjusting a phase of the spectrum RES derived from P(z) so that it is strictly real and for adjusting a phase of the spectrum IES derived from Q(z) so that it is strictly imaginary. The Fourier transform device may 8 be based on the fast Fourier transform or on the discrete Fourier transform.

According to an embodiment of the invention the adjustment device 7 is configured as a coefficient shifter 7 for circular shifting of coefficients of the pair of polynomials P(z) and Q(z) or one or more polynomials derived from the pair of polynomials P(z) and Q(z).

According to an embodiment of the invention the coefficient shifter 7 is configured for circular shifting of coefficients in such way that an original midpoint of a sequence of coefficients is shifted to the first position of the sequence.

In theory, it is well known that the Fourier transform of a symmetric sequence is real-valued and antisymmetric sequences have purely imaginary Fourier spectra. In the present case, our input sequence is the coefficients of polynomial P(z) or Q(z) which is of length m+l, whereas the discrete Fourier transform of a much greater length N>>(m+l) would be advantageous. The conventional approach for creating longer Fourier spectra is zero-padding of the input signal. However, zero-padding the sequence has to be carefully implemented such that the symmetries are retained.

First a polynomial P(z) with coefficients $[p_0, p_1, p_2, p_1, p_0]$ is considered.

The way fast Fourier transform algorithms are usually applied necessitates that the point of symmetry is the first element, whereby when applied for example in MATLAB one can write $\mathrm{fft}([p_2, p_1, p_0, p_0, p_1])$ to obtain a real-valued output. Specifically, a circular shift may be applied, such that the point of symmetry corresponding to the mid-point element, that is, coefficient $p_2$ is shifted left such that it is at the first position. The coefficients which were on the left side of $p_2$ are then appended to the end of the sequence.

For a zero-padded sequence $[p_0, p_1, p_2, p, p_0, 0, 0 \ldots 0]$ one can apply the same process. The sequence $[p_2, p_1, p_0, 0, 0 \ldots 0, p_0, p_1]$ will thus have a real-valued discrete Fourier transform. Here the number of zeros in the input sequences is N−m−l if N is the desired length of the spectrum.

Correspondingly, consider the coefficients $[q_0, q_1, 0, -q_1, -q_0]$ corresponding to polynomial Q(z). By applying a circular shift such that the former midpoint comes to the first position, one obtains $[0, -q_1, -q_0, q_0, q_1]$ which has a purely imaginary discrete Fourier transform. The zero-padded transform can then be taken for the sequence $[0, -q_1, -q_0, 0, 0 \ldots 0, q_0, q_1]$ Note that the above applies only for cases where the length of the sequence is odd, whereby m+l is even. For cases where m+l is odd, one have two options. Either one can implement the circular shift in the frequency domain or apply a DFT with half-samples.

According to an embodiment of the invention the converter 3 comprises a zero identifier 9 for identifying the zeros of the strictly real spectrum RES derived from P(z) and the strictly imaginary spectrum IES derived from Q(z).

According to an embodiment of the invention the zero identifier 9 is configured for identifying the zeros by a) starting with the real spectrum RES at null frequency;

b) increasing frequency until a change of sign at the real spectrum RES is found;

c) increasing frequency until a further change of sign at the imaginary spectrum IES is found; and d) repeating steps b) and c) until all zeros are found.

Note that Q(z) and thus the imaginary part IES of the spectrum has a zero at the null frequency. Since the roots are overlapping, P(z) and thus the real part RES of the spectrum will then be non-zero at the null frequency. One can therefore start with the real part RES at the null frequency and increase the frequency until the first change of sign is found, which indicates the first is zero-crossing and thus the first frequency value $f_1$.

Since the roots are interlaced, the spectrum IES of Q(z) will have the next change in sign. One can thus increase the frequency until a change of sign for the spectrum IES of Q(z) is found. This process then may be repeated, alternating between the spectra of P(z) and Q(z), until all frequency values $f_1 \ldots f_n$, have been found. The approach used for locating the zero-crossing in the spectra RES and IES is thus similar to the approach applied in the Chebyshev-domain [6, 7].

Since the zeros of P (z) and Q(z) are interlaced, one can alternate between searching for zeros on the real parts RES and complex parts IES, such that one finds all zeros in one pass, and reduce complexity by half in comparison to a full search.

According to an embodiment of the invention the zero identifier 9 is configured for identifying the zeros by interpolation.

In addition to the zero-crossing approach one can readily apply interpolation such that one can estimate the position of the zero with even higher accuracy, for example, as it is done in conventional methods, e.g. [7].

Figure 4:
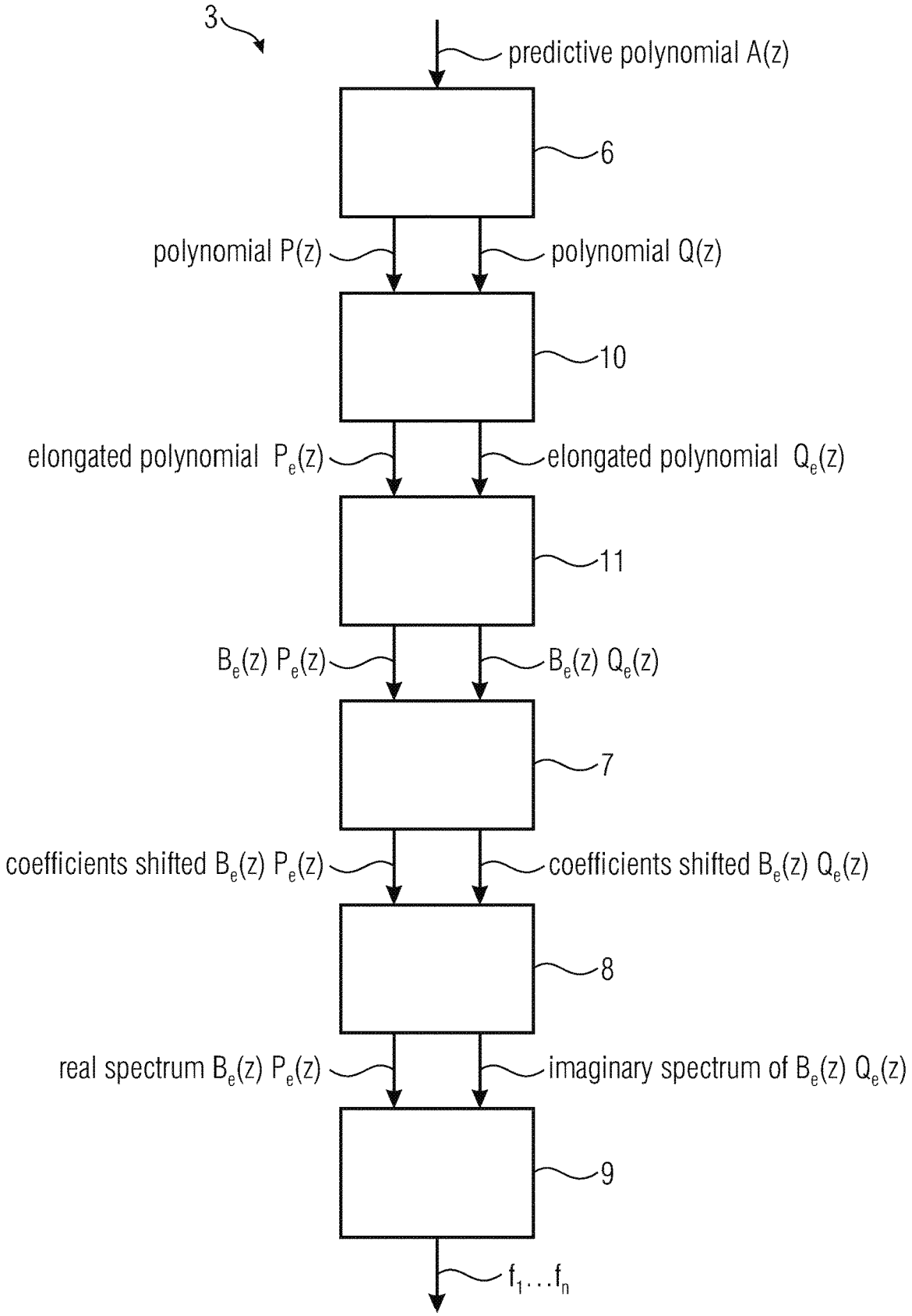
FIG. 4 illustrates a second embodiment of the converter of the information encoder according to the invention in a schematic view.

FIG. 4 illustrates a second embodiment of the converter 3 of the information encoder 1 according to the invention in a schematic view.

According to an embodiment of the invention the converter 3 comprises a zero-padding device 10 for adding one or more coefficients having a value "0" to the polynomials P(z) and Q(z) so as to produce a pair of elongated polynomials $P_e(z)$ and $Q_e(z)$. Accuracy can be further improved by extending the length of the evaluated spectrum RES, IES. Based on information about the system, it is actually possible in some cases to determine a minimum distance between the frequency values $f_1 \ldots f_n$, and thus determine the minimum length of the spectrum RES, IES with which all frequency values $f_1 \ldots f_n$, can be found [8].

According to an embodiment of the invention the converter 3 is configured in such way that during converting the linear prediction coefficients to frequency values $f_1 \ldots f_n$, of a spectral frequency representation RES, IES of the predictive polynomial A(z) at least a part of operations with coefficients known to be have the value "0" of the elongated polynomials $P_e(z)$ and $Q_e(z)$ are omitted.

Increasing the length of the spectrum does however also increase computational complexity. The largest contributor to the complexity is the time domain to frequency domain transform, such as a fast Fourier transform, of the coefficients of A(z). Since the coefficient vector has been zero-padded to the desired length, it is however very sparse. This fact can readily be used to reduce complexity. This is a rather simple problem in the sense that one knows exactly which coefficients are zero, whereby on each iteration of the fast Fourier transform one can simply omit those operations which involve zeros. Application of such sparse fast Fourier transform is straightforward and any programmer skilled in the art can implement it. The complexity of such an implementation is $O(N \log_2(1+m+l))$, where N is the length of the spectrum and m and l are defined as before.

According to an embodiment of the invention the converter comprises a limiting device 11 for limiting the numerical range of the spectra of the elongated polynomials $P_e(Z)$ and $Q_e(Z)$ or one or more polynomials derived from the elongated polynomials $P_e(Z)$ and $Q_e(z)$ by multiplying the elongated polynomials $P_e(Z)$ and $Q_e(Z)$ with a filter polynomial B(z), wherein the filter polynomial B(z) is symmetric and does not have any roots on a unit circle. B(z) can be found as explained above.

Figure 5:
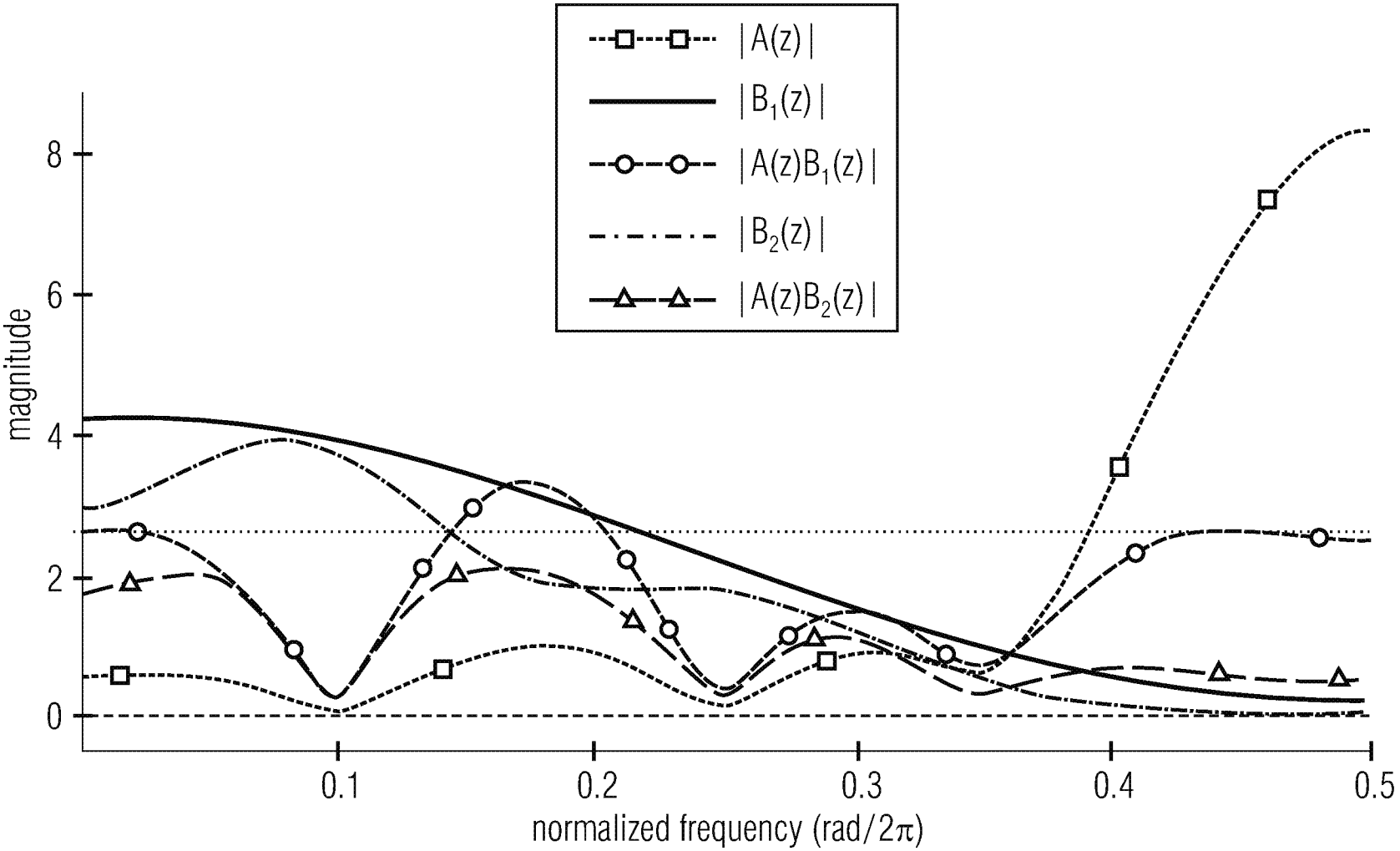
FIG. 5 illustrates an exemplary magnitude spectrum of a predictor A(z), the corresponding flattening filters $B_1(z)$ and $B_2(z)$ and the products $A(z)B_1(z)$ and $A(z)B_2(z)$.

FIG. 5 illustrates an exemplary magnitude spectrum of a predictor A(z), the corresponding flattening filters $B_1(z)$ and $B_2(z)$ and the products $A(z)B_1(z)$ and $A(z)B_2(z)$. The horizontal dotted line shows the level of $A(z)B_1(z)$ at the 0- and Nyquist-frequencies.

According to an embodiment (not shown) of the invention the converter 3 comprises a limiting device 11 for limiting the numerical range of the spectra RES, IES of the polynomials P(z) and Q(z) by multiplying the polynomials P(z) and Q(z) or one or more polynomials derived from the polynomials P(z) and Q(z) with a filter polynomial B(z), wherein the filter polynomial B(z) is symmetric and does not have any roots on a unit circle.

Speech codecs are often implemented on mobile device with limited resources, whereby numerical operations need to be implemented with fixed-point representations. It is therefore essential that algorithms implemented operate with numerical representations whose range is limited. For common speech spectral envelopes, the numerical range of the Fourier spectrum is, however, so large that one needs a 32-bit implementation of the FFT to ensure that the location of zero-crossings are retained.

A 16-bit FFT can, on the other hand, often be implemented with lower complexity, whereby it would be beneficial to limit the range of spectral values to fit within that 16-bit range. From the equations $|P(e^{i\theta})|\leq 2|A(e^{i\theta})|$ and $|Q(e^{i\theta})|\leq 2A(e^{i\theta})|$ it is known that by limiting the numerical range of B(z)A(z) one also limits the numerical range of B(z)P (z) and B(z)Q(z). If B(z) does not have zeros on the unit circle, then B(z)P (z) and B(z)Q(z) will have the same zero-crossing on the unit circle as P (z) and Q(z). Moreover, B(z) has to be symmetric such that $z^{-(m+l+n)/2}P(z)B(z)$ and $z^{-(m+l+n)/2}Q(z)B(z)$ remain symmetric and antisymmetric and their spectra are purely real and imaginary, respectively. Instead of evaluating the spectrum of $z^{(n+l)/2}A(z)$ one can thus evaluate $z^{(n+l+n)/2}A(z)B(z)$, where B(z) is an order n symmetric polynomial without roots on the unit circle. In other words, one can apply the same approach as described above, but first multiplying A(z) with filter B(z) and applying a modified phase-shift $z^{-(m+l+n)/2}$.

The remaining task is to design a filter B(z) such that the numerical range of A(z)B(z) is limited, with the restriction that B(z) has to be symmetric and without roots on the unit circle. The simplest filter which fulfills the requirements is an order 2 linear-phase filter $B_1(z)=\beta_0+\beta_1 z^{-1}+\beta_2 z^{-2}$, where $\beta_k\in R$ are the parameters and $|\beta_2|>2|\beta_3|$. By adjusting $\beta_k$ one can modify the spectral tilt and thus reduce the numerical range of the product $A(z)B_1(z)$. A computationally very efficient approach is to choose P such that the magnitude at 0-frequency and Nyquist is equal, $|A(1)B_1(1)|=|A(-1)B_1(-1)|$, whereby one can choose for example $\beta_0=A(1)-A(-1)$ and $\beta_1=2\ (A(1)+A(-1))$.

This approach provides an approximately flat spectrum.

One observes from FIG. 5 that whereas A(z) has a high-pass character, $B_1(z)$ is low-pass, whereby the product $A(z)B_1(z)$ has, as expected, equal magnitude at 0- and Nyquist-frequency and it is more or less flat. Since $B_1(z)$ has only one degree of freedom, one obviously cannot expect that the product would be completely flat. Still, observe that the ratio between the highest peak and lowest valley of $B_1(z)A(z)$ maybe much smaller than that of A(z).

This means that one have obtained the desired effect; the numerical range of $B_1(z)A(z)$ is much smaller than that of A(z).

A second, slightly more complex method is to calculate the autocorrelation $r_k$ of the impulse response of A(0.5z). Here multiplication by 0.5 moves the zeros of A(z) in the direction of origo, whereby the spectral magnitude is reduced approximately by half. By applying the Levinson-Durbin on the autocorrelation $r_k$, one obtains a filter H(z) of order n which is minimum-phase.

One can then define $B_2(z)=z^{-n}H(z)H(z^{-1})$ to obtain a $|B_2(z)A(z)|$ which is approximately constant. One will note that the range of $|B_2(z)A(z)|$ is smaller than that of $|B_1(z)A(z)|$. Further approaches for the design of B(z) can be readily found in classical literature of FIR design [18].

Figure 6:
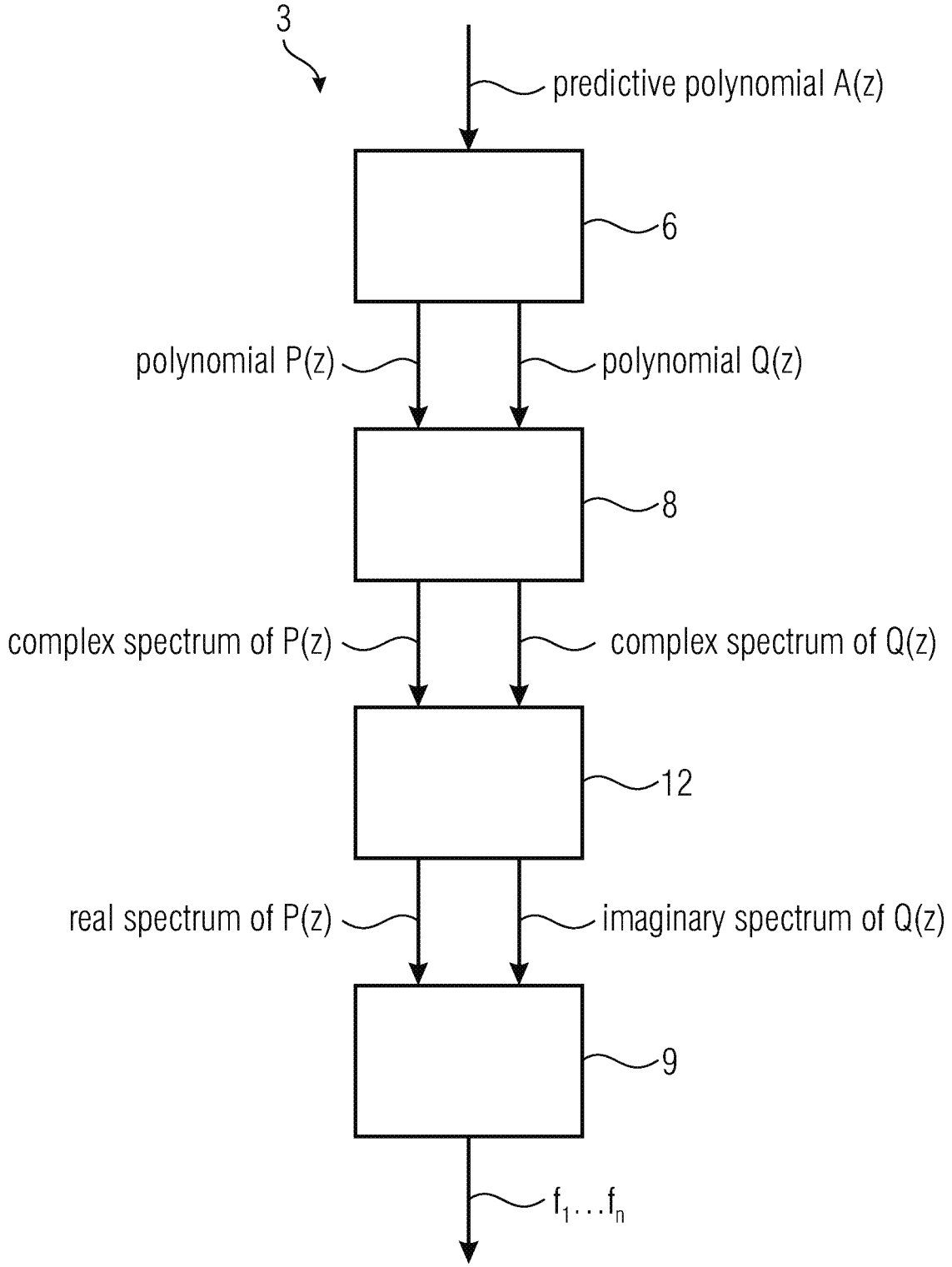
FIG. 6 illustrates a third embodiment of the converter of the information encoder according to the invention in a schematic view.

FIG. 6 illustrates a third embodiment of the converter 3 of the information encoder 1 according to the invention in a schematic view.

According to an embodiment of the invention the adjustment device 12 is configured as a phase shifter 12 for shifting a phase of the output of the Fourier transform device 8.

According to an embodiment of the invention the phase shifter 12 is configured for shifting the phase of the output of the Fourier transform device 8 by multiplying a k-th frequency bin with $\exp(i2\pi kh/N)$, wherein N is the length of the sample and h=(m+l)/2.

It is well-known that a circular shift in the time-domain is equivalent with a phase-rotation in the frequency-domain. Specifically, a shift of h=(m+l)/2 steps in the time domain corresponds to multiplication of the k-th frequency bin with $\exp(-i2\pi kh/N)$, where N is the length of the spectrum. Instead of the circular shift, one can thus apply a multiplication in the frequency-domain to obtain exactly the same result. The cost of this approach is a slightly increased complexity. Note that h=(m+l)/2 is an integer number only when m+l is even. When m+l is odd, the circular shift would involve a delay by rational number of steps, which is difficult to implement directly. Instead, one can apply the corresponding shift in the frequency domain by the phase-rotation described above.

Figure 7:
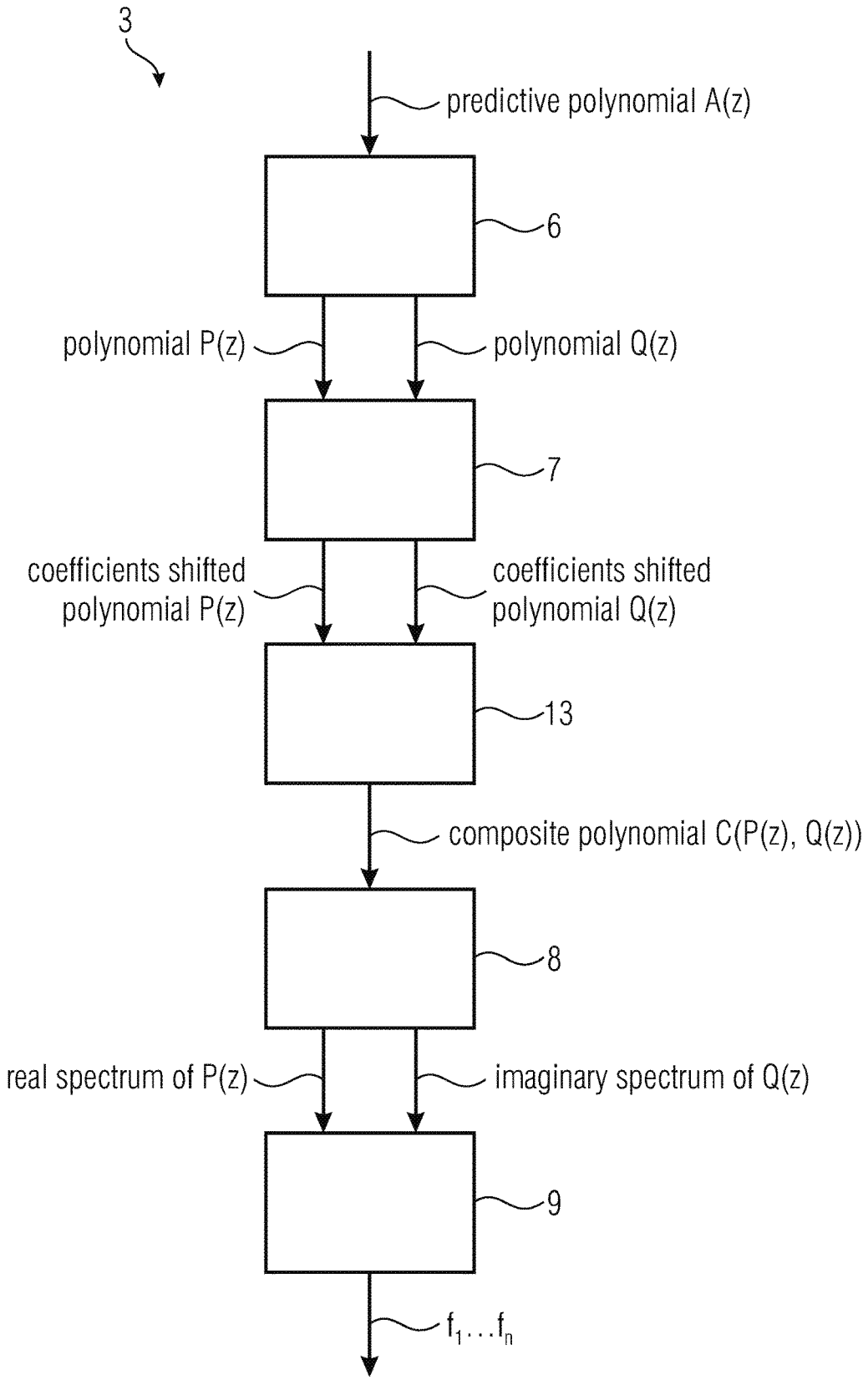
FIG. 7 illustrates a fourth embodiment of the converter of the information encoder according to the invention in a schematic view.

FIG. 7 illustrates a fourth embodiment of the converter 3 of the information encoder 1 according to the invention in a schematic view.

According to an embodiment of the invention the converter 3 comprises a composite polynomial former 13 configured to establish a composite polynomial C(P(z), Q(z)) from the polynomials P(z) and Q(z).

According to an embodiment of the invention the converter 3 is configured in such way that the strictly real spectrum derived from P(z) and the strictly imaginary spectrum from Q(z) are established by a single Fourier transform, for example a fast Fourier transform (FFT), by transforming a composite polynomial C(P(z), Q(z)).

The polynomials P (z) and Q(z) are symmetric and antisymmetric, respectively, with the axis of symmetry at $z^{-(m+l)/2}$. It follows that the spectra of $z^{-(m+l)/2}P(z)$ and $z^{-(m+l)/2}Q(z)$, respectively, evaluated on the unit circle $z=\exp(i\theta)$, are real and complex valued, respectively. Since the zeros are on the unit circle, one can find them by searching for zero-crossings. Moreover, the evaluation on the unit-circle can be implemented simply by an fast Fourier transform.

As the spectra corresponding to $z^{-(m+l)/2}P(Z)$ and $z^{-(m+l)/2}Q(z)$ are real and complex, respectively, 2 is one can implement them with a single fast Fourier transform. Specifically, if one take the sum $z^{-(m+l)/2}(P(z)+Q(z))$ then the real and complex parts of the spectra correspond to $z^{-(m+l)/2}P(z)$ and $z^{-(m+l)/2}Q(z)$, respectively. Moreover, since $z^{-(m+l)/2}(P(z)+Q(z))=2z^{-(m+l)/2}A(z)$, one can directly take the FFT of $2z^{-(m+l)/2}A(z)$ to obtain the spectra corresponding to $z^{-(m+l)/2}P(z)$ and $z^{-(m+l)/2}Q(z)$, without explicitly determining P(z) and Q(z). Since one is interested only in the locations of zeros, 1 can omit multiplication by the scalar 2 and evaluate $z^{-(m+l)/2}A(z)$ by FFT instead. Observe that since A(z) has only m+1 non-zero coefficients, one can use FFT pruning to reduce complexity [11]. To ensure that all roots are found, one has to use an FFT of sufficiently high length N that the spectrum is evaluated on at least one frequency between every two zeros.

According to an embodiment (not shown) of the invention the converter 3 comprises a composite polynomial former configured to establish a composite polynomial $C_e(P_e(z), Q_e(z))$ from the elongated polynomials $P_e(z)$ and $Q_e(z)$.

According to an embodiment (not shown) of the invention the converter is configured in such way that the strictly real spectrum derived from P(z) and the strictly imaginary spectrum from Q(z) are established by a single Fourier transform by transforming the composite polynomial $C_e(P_e(z), Q_e(z))$.

Figure 8:
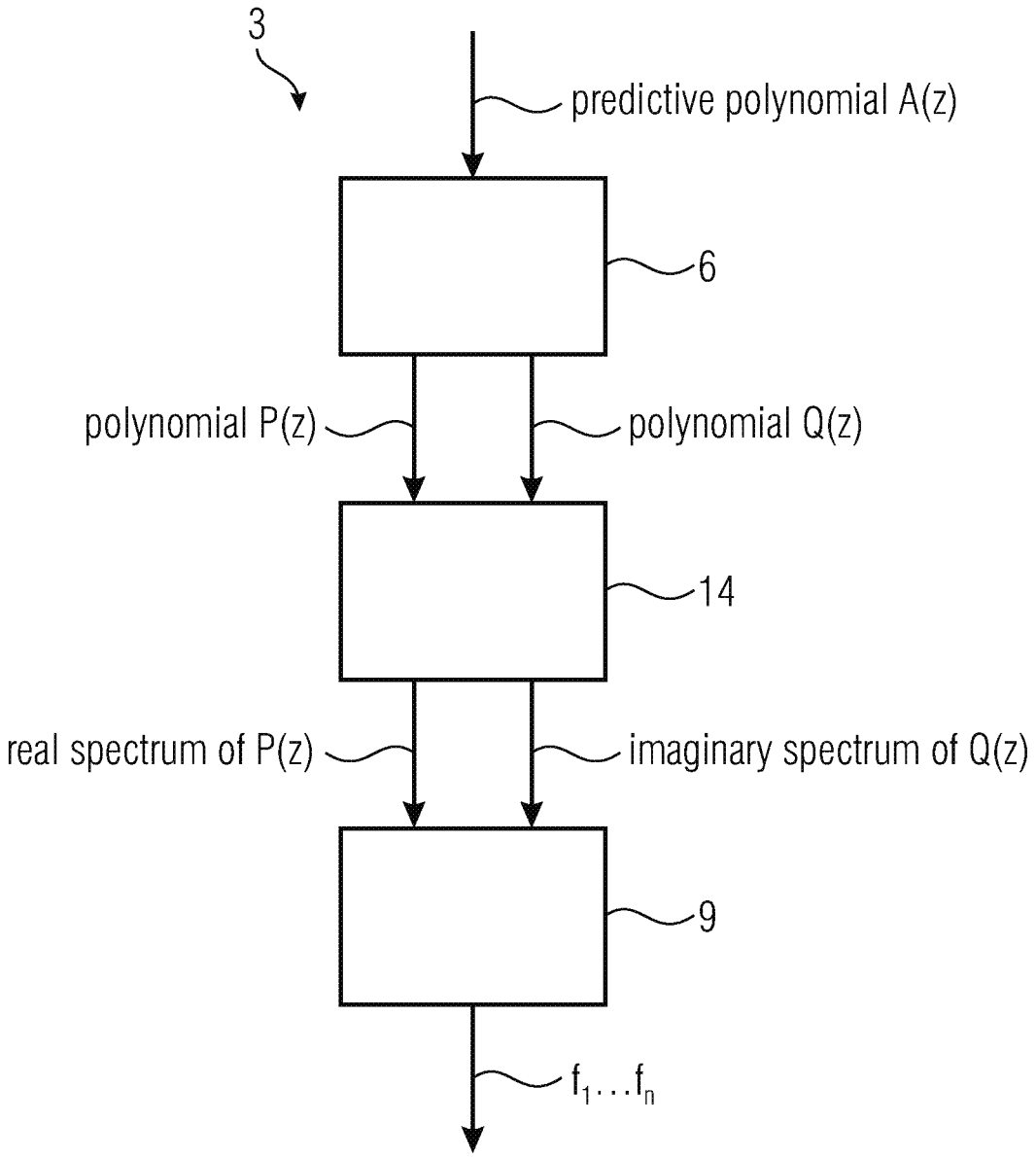
FIG. 8 illustrates a fifth embodiment of the converter of the information encoder according to the invention in a schematic view.

FIG. 8 illustrates a fifth embodiment of the converter 3 of the information encoder 1 according to the invention in a schematic view.

According to an embodiment of the invention the converter 3 comprises a Fourier transform device 14 for Fourier transforming the pair of polynomials P(z) and Q(z) or one or more polynomials derived from the pair of polynomials P(z) and Q(z) into a frequency domain with half samples so that the spectrum derived from P(z) is strictly real and so that the spectrum derived from Q(z) is strictly imaginary.

An alternative is to implement a DFT with half-samples. Specifically, whereas the conventional DFT is defined as $$X_k = \sum_{n=0}^{N-1} x_N \exp(-i2\pi kn/N)$$

one can define the half-sample DFT as $$X_k = \sum_{n=0}^{N-1} x_N \exp\left(-i2\pi k\left(n+\frac{1}{2}\right)/N\right)$$

A fast implementation as FFT can readily be devised for this formulation.

The benefit of this formulation is that now the point of symmetry is at n=½ instead of the usual n=1. With this half-sample DFT one would then with a sequence

[2, 1, 0, 0, 1, 2]

obtain a real-valued Fourier spectrum RES.

In the case of odd m+l, for a polynomial P(z) with coefficients $p_0, p_1, p_2, p_2, p_1, p_0$ one can then with a half-sample DFT and zero padding obtain a real valued spectrum RES when the input sequence is $[p_2, p_1, p_0, 0, 0 \ldots 0, p_0, p_1, p_2]$.

Correspondingly, for a polynomial Q(z) one can apply the half-sample DFT on the sequence $[-q_2, -q_1, -q_0, 0, 0 \ldots 0, q_0, q_1, q_2]$ to obtain a purely imaginary spectrum IES.

With these methods, for any combination of m and l, one can obtain a real valued spectrum for a polynomial P(z) and a purely imaginary spectrum for any Q(z). In fact, since the spectra of P(z) and Q(z) are purely real and imaginary, respectively, one can store them in a single complex spectrum, which then corresponds to the spectrum of P(z)+Q(z)=2A(z). Scaling by the factor 2 does not change the location of roots, whereby it can be ignored. One can thus obtain the spectra of P(z) and Q(z) by evaluating only the spectrum of A(z) using a single FFT. One only need to apply the circular shift, as explained above, to the coefficients of A(z).

For example, with m=4 and l=0, the coefficients of A(z) are $[a_0, a_1, a_2, a_3, a_4]$ which one can zero-pad to an arbitrary length N by $[a_0, a_1, a_2, a_3, a_4, 0, 0 \ldots 0]$.

If one then applies a circular shift of (m+l)/2=2 steps, one obtains $[a_2, a_3, a_4, 0, 0 \ldots 0, a_0, a_1]$.

By taking the DFT of this sequence, one has the spectrum of P(z) and Q(z) in the real parts RES and complex parts IES of the spectrum.

The overall algorithm in the case where m+l is even can be stated as follows. Let the coefficients of A(z), denoted by $a_k$, reside in a buffer of length N.

1. Apply a circular shift on $a_k$ of (m+l)/2 steps to the left.
2. Calculate the fast Fourier transform of the sequence $a_k$ and denote it by $A_k$.
3. Until all frequency values have been found, start with k=0 and alternate between (a) While sign(real($A_k$))=sign(real($A_k$+1)) increase k:=k+1. Once the zero-crossing has been found, store k in the list of frequency values.

(b) While sign(imag($A_k$))=sign(imag($A_k$+1)) increase k:=k+1. Once the zero-crossing has been found, store k in the list of frequency values.

4. For each frequency value, interpolate between $A_k$ and $A_k$+1 to determine the accurate position.

Here the functions sign(x), real(x) and imag(x) refer to the sign of x, the real part of x and the imaginary part of x, respectively.

For the case of m+l odd, the circular shift is reduced to only (m+l−1)/2 steps left and the regular fast Fourier transform is replaced by the half-sample fast Fourier transform.

Alternatively, we can replace the combination of circular shift and 1st Fourier transform, with fast Fourier transform and a phase-shift in frequency domain.

For more accurate locations of roots, it is possible to use the above proposed method to provide a first guess and then apply a second step which refines the root loci. For the refinement, we can apply any classical polynomial root finding method such as Durand-Kerner, Aberth-Ehrlich's, Laguerre's the Gauss-Newton method or others [11-17].

In one formulation, the presented method consists of the following steps:

(a) For a sequence of length m+l+1 zero-padded to length N, where m+l is even, apply a circular shift of (m+l)/2 steps to the left, such that the buffer length is N and corresponds to the desired length of the output spectrum, or for a sequence of length m+l+1 zero-padded to length N, where m+l is odd, apply a circular shift of (m+l−1)/2 steps to the left, such that the buffer length is N and corresponds to the desired length of the output spectrum.

(b) If m+l is even, apply a regular DFT on the sequence. If m+l is odd, apply a half-sampled DFT on the sequence as described by Eq. 3 or an equivalent representation.

(c) If the input signal was symmetric or antisymmetric, search for zero-crossings of the frequency domain representation and store the locations in a list.

If the input signal was a composite sequence B(z)=P (z)+Q(z), search for zero-crossings in both the real and the imaginary part of the frequency domain representation and store the locations in a list. If the input signal was a composite sequence B(z)=P (z)+Q(z), and the roots of P (z) and Q(z) alternate or have similar structure, search for zero-crossings by alternating between the real and the imaginary part of the frequency domain representation and store the locations in a list.

In another formulation, the presented method consists of the following steps (a) For an input signal which is of the same form as in the previous point, apply the DFT on the input sequence.

(b) Apply a phase-rotation to the frequency-domain values, which is equivalent to a circular shift of the input signal by (m+l)/2 steps to the left.

(c) Apply a zero-crossing search as was done in the previous point.

With respect to the encoder 1 and the methods of the described embodiments the following is mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] B. Bessette, R. Salami, R. Lefebvre, M. Jelinek, J. Rotola-Pukkila, J. Vainio, H. Mikkola, and K. Jarvinen, "The adaptive multirate wideband speech codec (AMR-WB)", Speech and Audio Processing, IEEE Transactions on, vol. 10, no. 8, pp. 620-636, 2002.

[2] ITU-T G.718, "Frame error robust narrow-band and wideband embedded variable bit-rate coding of speech and audio from 8-32 kbit/s", 2008.

[3] M. Neuendorf, P. Gournay, M. Multrus, J. Lecomte, B. Bessette, R. Geiger, S. Bayer, G. Fuchs, J. Hilpert, N. Rettelbach, R. Salami, G. Schuller, R. Lefebvre, and B. Grill, "Unified speech and audio coding scheme for high quality at low bitrates", in Acoustics, Speech and Signal Processing. ICASSP 2009. IEEE Int Conf, 2009, pp. 1-4.

[4] T. Backstrim and C. Magi, "Properties of line spectrum pair polynomials—a review", Signal Processing, vol. 86, no. 11, pp. 3286-3298, November 2006.

[5] G. Kang and L. Fransen, "Application of line-spectrum pairs to low-bitrate speech encoders", in Acoustics, Speech, and Signal Processing, IEEE International Conference on ICASSP'85., vol. 10. IEEE, 1985, pp. 244-247.

[6] P. Kabal and R. P. Ramachandran, "The computation of line spectral frequencies using Chebyshev polynomials", Acoustics, Speech and Signal Processing, IEEE Transactions on, vol. 34, no. 6, pp. 1419-1426, 1986.

[7] 3GPP TS 26.190 V7.0.0, "Adaptive multi-rate (AMR-WB) speech codec", 2007.

[8] T. Backstrim, C. Magi, and P. Alku, "Minimum separation of line spectral frequencies", IEEE Signal Process. Lett., vol. 14, no. 2, pp. 145-147, February 2007.

[9] T. Backstrom, "Vandermonde factorization of Toeplitz matrices and applications in filtering and warping," IEEE Trans. Signal Process., vol. 61, no. 24, pp. 6257-6263, 2013.

[10] V. F. Pisarenko, "The retrieval of harmonics from a covariance function", Geophysical Journal of the Royal Astronomical Society, vol. 33, no. 3, pp. 347-366, 1973.

[11] E. Durand, Solutions Numeriques des Equations Algebriques. Paris: Masson, 1960.

[12] I. Kerner, "Ein Gesamtschrittverfahren zur Berechnung der Nullstellen von Polynomen", Numerische Mathematik, vol. 8, no. 3, pp. 290-294, May 1966.

[13] O. Aberth, "Iteration methods for finding all zeros of a polynomial simultaneously", Mathematics of Computation, vol. 27, no. 122, pp. 339-344, April 1973.

[14] L. Ehrlich, "A modified newton method for polynomials", Communications of the ACM, vol. 10, no. 2, pp. 107-108, February 1967.

[15] D. Starer and A. Nehorai, "Polynomial factorization algorithms for adaptive root estimation", in Int. Conf. on Acoustics, Speech, and Signal Processing, vol. 2. Glasgow, UK: IEEE, May 1989, pp. 1158-1161.

[16] D. Starer et al., "Adaptive polynomial factorization by coefficient matching", IEEE Transactions on Signal Processing, vol. 39, no. 2, pp. 527-530, February 1991.

[17] G. H. Golub and C. F. van Loan, Matrix Computations, 3rd ed. John Hopkins University Press, 1996.

[18] T. Saramaki, "Finite impulse response filter design", Handbook for Digital Signal Processing, pp. 155-277, 1993.

The invention claimed is:

1. An information encoder for encoding an information signal, the information encoder comprising:

an analyzer for analyzing the information signal in order to acquire linear prediction coefficients of a predictive polynomial A(z);

a converter for converting the linear prediction coefficients of the predictive polynomial A(z) to frequency values $f_1 \ldots f_n$ of a spectral frequency representation of the predictive polynomial A(z), wherein the converter is configured to determine the frequency values $f_1 \ldots f_n$ by analyzing a pair of polynomials P(z) and Q(z) being defined as $$P(z)=A(z)+z-m-lA(z-1) \text{ and}$$

$$Q(z)=A(z)-z-m-lA(z-1)$$

wherein m is an order of the predictive polynomial A(z) and l is greater or equal to zero, wherein the converter is configured to acquire the frequency values by establishing a strictly real spectrum derived from P(z) and a strictly imaginary spectrum from Q(z) and by identifying zeros of the strictly real spectrum derived from P(z) and the strictly imaginary spectrum derived from Q(z);

a quantizer for acquiring quantized frequency values from the frequency values; and a bitstream producer for producing a bitstream comprising the quantized frequency values, wherein the converter comprises a zero-padding device for adding one or more coefficients comprising a value "0" to the polynomials P(z) and Q(z) so as to produce a pair of elongated polynomials $P_e(z)$ and $Q_e$.

2. The information encoder according to claim 1, wherein the converter comprises a determining device to determine the polynomials P(z) and Q(z) from the predictive polynomial A(z).

3. The information encoder according to claim 1, wherein the converter comprises a zero identifier for identifying the zeros of the strictly real spectrum derived from P(z) and the strictly imaginary spectrum derived from Q(z).

4. The information encoder according to claim 3, wherein the zero identifier is configured for identifying the zeros by a) starting with the real spectrum at null frequency;

b) increasing frequency until a change of sign at the real spectrum is found;

c) increasing frequency until a further change of sign at the imaginary spectrum is found; and d) repeating b) and c) until all zeros are found.

5. The information encoder according to claim 3, wherein the zero identifier is configured for identifying the zeros by interpolation.

6. The information encoder according to claim 5, wherein the converter is configured in such way that during converting the linear prediction coefficients to frequency values of the spectral frequency representation of the predictive polynomial A(z) at least a part of operations with coefficients known to comprise the value "0" of the elongated polynomials $P_e(z)$ and $Q_e(z)$ are omitted.

7. The information encoder according to claim 5, wherein the converter comprises a composite polynomial former configured to establish a composite polynomial $C_e(P_e(z), Q_e(Z))$ from the elongated polynomials $P_e(Z)$ and $Q_e(Z)$.

8. The information encoder according to claim 7, wherein the converter is configured in such way that the strictly real spectrum derived from P(z) and the strictly imaginary spectrum from Q(z) are established by a single Fourier transform by transforming the composite polynomial $C_e(P_e(Z), Q_e(Z))$.

9. The information encoder according to claim 1, wherein the converter comprises a Fourier transform device for Fourier transforming the pair of polynomials P(z) and Q(z) or one or more polynomials derived from the pair of polynomials P(z) and Q(z) into a frequency domain and an adjustment device for adjusting a phase of the spectrum derived from P(z) so that it is strictly real and for adjusting a phase of the spectrum derived from Q(z) so that it is strictly imaginary.

10. The information encoder according to claim 9, wherein the adjustment device is configured as a coefficient shifter for circular shifting of coefficients of the pair of polynomials P(z) and Q(z) or the one or more polynomials derived from the pair of polynomials P(z) and Q(z).

11. The information encoder according to claim 10, wherein the coefficient shifter is configured for circular shifting of coefficients in such way that an original midpoint of a sequence of coefficients is shifted to the first position of the sequence.

12. The information encoder according to claim 9, wherein the adjustment device is configured as a phase shifter for shifting a phase of the output of the Fourier transform device.

13. The information encoder according to claim 12, wherein the phase shifter is configured for shifting the phase of the output of the Fourier transform device by multiplying a k-th frequency bin with $\exp(i2\pi kh/N)$, wherein N is the length of the sample and $h=(m+l)/2$.

14. The information encoder according to claim 1, wherein the converter comprises a Fourier transform device for Fourier transforming the pair of polynomials P(z) and Q(z) or one or more polynomials derived from the pair of polynomials P(z) and Q(z) into a frequency domain with half samples so that the spectrum derived from P(z) is strictly real and so that the spectrum derived from Q(z) is strictly imaginary.

15. The information encoder according to claim 1, wherein the converter comprises a composite polynomial former configured to establish a composite polynomial C(P(z), Q(z)) from the polynomials P(z) and Q(z).

16. The information encoder according to claim 15, wherein the converter is configured in such way that the strictly real spectrum derived from P(z) and the strictly imaginary spectrum from Q(z) are established by a single Fourier transform by transforming the composite polynomial C(P(z), Q(z)).

17. The information encoder according to claim 1, wherein the converter comprises a limiting device for limiting the numerical range of the spectra of the polynomials P(z) and Q(z) by multiplying the polynomials P(z) and Q(z) or one or more polynomials derived from the polynomials P(z) and Q(z) with a filter polynomial B(z), wherein the filter polynomial B(z) is symmetric and does not comprise any roots on a unit circle.

18. The information encoder according claim 1, wherein the converter comprises a limiting device for limiting the numerical range of the spectra of the elongated polynomials $P_e(z)$ and $Q_e(z)$ or one or more polynomials derived from the elongated polynomials $P_e(z)$ and $Q_e(z)$ by multiplying the elongated polynomials $P_e(z)$ and $Q_e(z)$ with a filter polynomial B(z), wherein the filter polynomial B(z) is symmetric and does not comprise any roots on a unit circle.

19. A method for operating an information encoder for encoding an information signal, the method comprising:

analyzing the information signal in order to acquire linear prediction coefficients of a predictive polynomial A(z);

converting the linear prediction coefficients of the predictive polynomial A(z) to frequency values of a spectral frequency representation of the predictive polynomial A(z), wherein the frequency values are determined by analyzing a pair of polynomials P(z) and Q(z) being defined as $$P(z)=A(z)+z-m-lA(z-1) \text{ and}$$

$$Q(z)=A(z)-z-m-lA(z-1)$$

wherein m is an order of the predictive polynomial A(z) and l is greater or equal to zero, wherein the frequency values are acquired by establishing a strictly real spectrum derived from P(z) and a strictly imaginary spectrum from Q(z) and by identifying zeros of the strictly real spectrum derived from P(z) and the strictly imaginary spectrum derived from Q(z);

acquiring quantized frequency values from the frequency values; and producing a bitstream comprising the quantized frequency values, wherein the converter comprises a zero-padding device for adding one or more coefficients comprising a value "0" to the polynomials P(z) and Q(z) so as to produce a pair of elongated polynomials $P_e(z)$ and $Q_e(z)$.

20. A non-transitory digital storage medium having a computer program stored thereon to perform a method for operating an information encoder for encoding an information signal, the method comprising:

analyzing the information signal in order to acquire linear prediction coefficients of a predictive polynomial A(z);

converting the linear prediction coefficients of the predictive polynomial A(z) to frequency values of a spectral frequency representation of the predictive polynomial A(z), wherein the frequency values are determined by analyzing a pair of polynomials P(z) and Q(z) being defined as $$P(z)=A(z)+z-m-lA(z-1) \text{ and}$$

$$Q(z)=A(z)-z-m-lA(z-1),$$

wherein m is an order of the predictive polynomial A(z) and l is greater or equal to zero, wherein the frequency values are acquired by establishing a strictly real spectrum derived from P(z) and a strictly imaginary spectrum from Q(z) and by identifying zeros of the strictly real spectrum derived from P(z) and the strictly imaginary spectrum derived from Q(z);

acquiring quantized frequency values from the frequency values; and producing a bitstream comprising the quantized frequency values, wherein the converter comprises a zero-padding device for adding one or more coefficients comprising a value "0" to the polynomials P(z) and Q(z) so as to produce a pair of elongated polynomials $P_e(z)$ and $Q_e(z)$, when said computer program is run by a computer.

* * * * *